US006106210A

United States Patent [19]

Toxer

[11] Patent Number: 6,106,210

[45] Date of Patent: Aug. 22, 2000

[54] PARKING APPARATUS

[75] Inventor: Shigeo Toxer, Amagasaki, Japan

[73] Assignee: Miyoshi Iron Works Co., Ltd., Japan

[21] Appl. No.: 09/157,043

[22] Filed: Sep. 18, 1998

[30] Foreign Application Priority Data

Sep. 19, 1997 [JP] Japan ..... 9-255529
Dec. 12, 1997 [JP] Japan ..... 9-342549

[51] Int. Cl.[7] ..... E04H 6/12

[52] U.S. Cl. ..... 414/234; 414/232; 414/236

[58] Field of Search ..... 414/234, 228, 414/236, 237, 240, 242, 252, 261, 232; 187/213, 279, 277

[56] References Cited

U.S. PATENT DOCUMENTS

| | | | |
|---|---|---|---|
| 2,911,115 | 11/1959 | Jacobsen, Jr. | 414/242 |
| 2,930,497 | 3/1960 | Wheeler | 414/234 |
| 2,936,082 | 5/1960 | Alimanestiano | 414/234 |
| 3,457,668 | 7/1969 | Genin | 414/228 |
| 3,706,356 | 12/1972 | Herbst et al. | 414/228 |
| 4,674,938 | 6/1987 | Van Stokes et al. | 414/228 |
| 4,826,384 | 5/1989 | Okura et al. | 414/234 |
| 4,869,634 | 9/1989 | Carter | 414/240 |
| 5,018,926 | 5/1991 | Sternad | 414/234 |
| 5,810,539 | 9/1998 | Zhang et al. | 414/234 |
| 5,868,540 | 2/1999 | Hirose et al. | 414/234 |

*Primary Examiner*—Steven A. Bratlie

*Attorney, Agent, or Firm*—Schweitzer Cornman Gross & Bondell LLP

[57] ABSTRACT

The invention relates to a parking apparatus having a plurality of vertically movable vehicle supporting platforms for being lifted and lowered between a lower vehicle supporting level and an upper vehicle supporting level and arranged horizontally in a mutually parallel relationship, positioning structure for respective vertically movable vehicle supporting platforms for selectively preventing the vertically movable vehicle supporting platforms from being lowered from their upper vehicle supporting level or from being lifted from a vehicle positioning state of their lower vehicle supporting level, the positioning structure being switchable from the vehicle positioning state to a released state in which lifting or lowering if the vertically movable vehicle supporting platform is enabled, a lifting drive of the vertically movable vehicle supporting platforms, the lifting drive including a motor, and a wind-up body driven by the motor, a frame, a plurality of suspending cables suspending respective vertically movable vehicle supporting platforms, the suspending cables having one end thereof attached to the frame for pulling and releasing the other end of the cable by the wind-up body, a suspending guide wheel, a stationary guide wheel rotatably supporting the suspending guide wheel, the stationary guide wheel being rotatably supported from the frame for lifting and lowering a respective vertically movable vehicle supporting platform in cooperation with one of the positioning structure.

15 Claims, 25 Drawing Sheets

PARKING APPARATUS

FIELD OF THE INVENTION

The present invention relates to a parking apparatus, in which a plurality of a vertically movable vehicle supporting platforms are lifted and lowered between a lower vehicle support level and an upper vehicle support level that are arranged in parallel relationship, independently of other platforms.

BACKGROUND

Parking apparatus of this type has laterally movable vehicle supporting platforms one fewer in number than the number of parallel arranged vertically movable vehicle supporting platforms to support vehicles on respective vertically movable vehicle supporting platforms and respective laterally movable vehicle supporting platforms on a lower vehicle supporting level, or without using any laterally movable vehicle supporting platforms, to support the vehicles on a floor surface of the lower vehicle supporting level and on respective vertically movable vehicle supporting platforms to use as parking apparatus to store the vehicles at two respective upper and lower stages. Conventionally, the parking apparatus of this type is provided with a lifting drive including lifting drive motors for respective vertically movable vehicle supporting platforms.

In this type of conventional parking apparatus, the lifting drive including the lifting drive motors are required to be equal in number to the number of the vertically movable vehicle supporting platforms. A control system becomes complicate, correspondingly, the overall apparatus is of a high cost.

SUMMARY OF THE INVENTION

The present invention aims at solving the aforementioned problem.

Accordingly, one aspect of the present invention, a parking apparatus of the present invention comprises (i) a plurality of vertically movable vehicle supporting platforms for being lifted and lowered between a lower vehicle supporting level and an upper vehicle supporting level and arranged horizontally in a mutually parallel relationship, positioning means for respective vertically movable vehicle supporting platforms for selectively preventing the vertically movable vehicle supporting platforms from being lowered from their upper vehicle supporting level or from being lifted from a vehicle positioning state of their lower vehicle supporting level, the positioning means being switchable from the vehicle positioning state to a released state in which lifting or lowering if the vertically movable vehicle supporting platform is enabled, a lifting drive of the vertically movable vehicle supporting platforms, the lifting drive including a motor, and a wind-up body driven by the motor, a frame, a plurality of suspending cables suspending respective vertically movable vehicle supporting platforms, the suspending cables having one end thereof attached to said frame for pulling and releasing the other end of the cable by said wind-up body, a suspending guide wheel, a stationary guide wheel rotatably supporting the suspending guide wheel, the stationary guide wheel being rotatably supported from the frame for lifting and lowering a respective vertically movable vehicle supporting platform in cooperation with one of the positioning means.

In the above parking apparatus of the present invention an arbitrary one of the vertically movable vehicle supporting platforms among the vertically movable vehicle supporting platforms maintained at the upper vehicle supporting level, can be lowered to the lower vehicle supporting level to permit insertion and removal of a vehicle. In such case, when no obstacle, such as vehicle, is present directly below the vertically movable vehicle supporting platform to be lowered, only the positioning means corresponding to the vertically movable vehicle supporting platform in question is released to permit lowering of the vertically movable vehicle supporting platform. Then, by withdrawing the suspending cable from the wind-up means, only the vertically movable vehicle supporting platform corresponding to the released positioning means can be lowered when withdrawing the suspending cable. At this time, the remaining vertically movable vehicle supporting platforms are aligned by the positioning means in the positioning state and thus cannot be lowered.

In the above parking apparatus of the present invention an arbitrary one of the vertically movable vehicle supporting platforms among the vertically movable vehicle supporting platforms maintained at the upper vehicle supporting level, can be lifted to the upper vehicle supporting level to permit insertion and removal of the vehicle. Where no obstacle, such as a vehicle, is present directly above the vertically movable vehicle supporting platform to be lifted, only positioning means of the vertically movable vehicle supporting platform in question is released to permit lifting of the vertically movable vehicle supporting platform. Then, by withdrawing the suspending cable from the wind-up means, only the vertically movable vehicle supporting platform corresponding to the positioning means in the released condition, can be lifted by withdrawal of the suspending cable. At this time, the remaining vertically movable vehicle supporting platforms are in the positioning state and thus cannot be lowered.

While a plurality of vertically movable vehicle supporting platforms are arranged parallel to each other, it is not necessary to provide the lifting drive including the motor driven withdrawing and loosening means and the suspending cables to be operated for pulling and releasing for each vertically movable vehicle supporting platform and thus make the structure of the overall apparatus quite simple. With this structure, control of the lifting drive for driving to lift and to lower the vertically movable vehicle supporting platforms can be made simple to make the overall apparatus rather inexpensive.

In the foregoing construction, the suspending cables of the lifting drive can be chains attached to the frame at both ends, and the wind-up means of the lifting drive includes driving sprockets coupled with the motor and lifting sprockets arranged below the driving sprockets for lifting and lowering, and the suspending cables can be lowered down by the lifting sprockets in the vertical portion between one end attached to the frame and the driving sprockets. With this structure, when pulling or releasing the suspending cable (chain) by rotating the driving sprocket for lifting and lowering the vertically movable vehicle supporting platform, since as the lifting sprocket is lifted and lowered, the lifted position of the vertically movable vehicle supporting platform selectively lifted up and down can be detected by using the up and down motion of the lifting sprocket. Therefore, control can be facilitated compared to the case where the position has to be detected for each vertically movable vehicle supporting platform.

The wind-up means of the lifting drive can be a motor driven rotary body for winding up the suspending cables of the lifting drive, and wire ropes engaged on a stationary frame attached at one end and operated to be released by the rotary wind-up body at the other end. This compared to the case where the chain is used as the suspending cable of structure for pulling and releasing the suspending cable can be simplified for simple and inexpensive implementation. When such a wire rope is employed, respective lifting vehicle supporting platforms are suspended with wrapping around suspended sheaves rotatably supported on respective ones of the lifting vehicle supporting platforms and suspending sheaves rotatably supported on the stationary frame above the suspended sheaves. Durability of the wire rope can be improved with this structure, and thus the safety of the apparatus can be improved.

The rotary wind-up body of the wind-up means can be wrapped around in a groove having a loosely engaging with only one wire rope in a spiral fashion. The rotary wind-up body of the lifting drive can thus be provided in the vicinity of the suspending sheaves on the stationary frame through which the wire rope passes at first, to reduce the occupied space of the overall lifting drive.

The parking apparatus further includes a spring which is interposed between an end of the wire rope on the opposite side of the rotary wind-up body and the stationary frame to maintain the wire rope tensioned by the force of the spring when the lowered lifting vehicle supporting platform is received on the lower vehicle supporting level. Thus, when the lowered vertically movable vehicle supporting platform is received at the lower vehicle supporting level, relaxing of the wire rope due to time lag to actually stop the rotary wind-up body, can be avoided.

The parking apparatus further includes a sensor which is provided for detecting movement of the end of the wire rope against the force of the spring after all of the lifting vehicle supporting platforms are at the upper vehicle supporting level, to terminate driving of the rotary wind-up body upon a detection signal of the sensor. Control for driving and stopping of the rotary wind-up body can be had by one sensor detecting movement of the end of the wire rope, without arranging the sensor for detecting the upper limit position for each of the vertically movable vehicle supporting platform.

A plurality of the suspending cables can be provided for suspending a plurality of positions in forward and reverse direction of the lifting vehicle supporting platforms, and a plurality of suspending cables can cooperate for driving by wind-up means with a single motor to perform tensioning and loosening operation. Thus, the vertically movable vehicle supporting platform can be stably driven to up and down without tilting.

Laterally movable vehicle supporting platforms having a number one less than the number of the lifting vehicle supporting platforms, can be provided for lateral motion. The positioning means is switchable between a positioning state preventing the lifting vehicle supporting platforms at the upper vehicle supporting level from being lowered and in the released state permitting lowering. Vehicle supporting platform receiving portion for receiving the lifting vehicle supporting platforms on the top of the laterally movable vehicle supporting platforms, and only one lifting vehicle supporting platform located above an empty space defined after lateral motion of the laterally movable vehicle supporting platform may be lowered. The laterally movable vehicle supporting platforms supporting the vehicle at the lower vehicle supporting level can be used with this as the positioning means necessary for each vertically movable vehicle supporting platform. Thus, in comparison with the case where a dedicated positioning means has to be provided for each vertically movable vehicle supporting platform, the construction and control can be simplified for making the apparatus even less costly.

The parking apparatus further comprises a tilt preventer for preventing tiling of the lifting vehicle supporting platforms suspended by the suspending cables aligned with the lifting vehicle supporting platforms. This successfully prevents tilting of the vertically movable vehicle supporting platform suspended by the suspending cable in the direction of the vertically movable vehicle supporting platforms to enhance the safety of the apparatus. In this case, the tilt preventers comprise two linking cables connected to both of the left and right sides of the lifting vehicle supporting platforms at both ends, and are wrapped around guide wheels rotatably supported at fixed position at intermediate positions, one of the linking cables being pulled to lower the left side of the lifting vehicle supporting platform or to lower the right side of the lifting vehicle supporting platform, and the other linking cable is pulled to lower the right side of the lifting vehicle supporting platform or to lower the left side of the lifting vehicle supporting platform. This tilt preventer for each vertically movable vehicle supporting platform can be simply built with a plurality of fixed guide wheels and two linking cables.

A parking apparatus comprising a plurality of vertically movable vehicle supporting platforms for being lifted and lowered between a first, a ground level for inserting and removing a vehicle in each of the platforms in a vehicle positioning state thereof, and a second level vertically offset from the first level, positioning means for respective vertically movable vehicle supporting platforms for selectively preventing the vertically movable vehicle supporting platforms from being moved from the second level to the first level, the positioning means being switchable from the vehicle positioning state to a released state in which vertical movement of the vertically movable vehicle supporting platform is enabled, a lifting drive for the vertically movable vehicle supporting platforms, the drive including a motor, and a wind-up body driven by the motor, a frame, a plurality of suspending cables suspending respective vertically movable vehicle supporting platforms, the suspending cables having one end thereof attached to the frame for pulling and releasing the other end of the cable by the wind-up body, and a suspending guide wheel, a stationary guide wheel rotatably supporting the suspending guide wheel, the stationary guide wheel being rotatably supported from the frame and a respective vertically movable vehicle supporting platform for lifting and lowering a respective vertically movable vehicle supporting platform in cooperation with the positioning means.

BRIEF DESCRIPTION OF THE DRAWING

The present invention will be understood more fully from the detailed description given herebelow and from the accompanying drawing, wherein FIGS. 1 to 19 show a first embodiment of a parking apparatus according to the present invention, in which FIG. 1 is a front elevational view showing the entire apparatus wherein all of the vertically movable vehicle supporting platforms are lifted up to an upper vehicle supporting level;

FIG. 2 is a front elevational view showing the entire apparatus wherein one of the vertically movable vehicle supporting platforms is lowered to a lower vehicle supporting level;

FIG. 3 is a side elevation of the entire apparatus;

FIG. 4 is a partly cut-out plan view of the entire apparatus;

FIG. 5 is a partly cut-out cross-sectional view taken along the line 5—5 of FIG. 1 (with unnecessary parts omitted), shown foreshortened in the front-to-back direction, for showing a carriage suspending a laterally movable vehicle supporting platform;

FIG. 6 is a front elevation of a lifting drive in which all of the vertically movable vehicle supporting platforms are lifted to the upper vehicle supporting level;

FIG. 7 is a front elevation showing one of the vertically movable vehicle supporting platforms lowered to the lower vehicle supporting level;

FIG. 8 is a partly cut-out side elevation showing a vertical portion of a lifting cable of the lifting drive;

FIG. 9 is a horizontal cross-sectional enlarged plan view of FIG. 8;

FIG. 10 is a partly cut-out front elevation showing a tilt preventer;

FIG. 11 is a perspective dramatic view of a linkage cable of the tilt preventer;

FIG. 12 is a longitudinally sectioned side elevation of a front end portion of a suspending structure of the laterally movable vehicle supporting platform;

FIG. 13 is a longitudinally sectioned side elevation of a rear end portion and a tilt preventer of the suspending structure of the laterally movable vehicle supporting platform;

FIG. 14 is a longitudinally sectioned side elevation of a carriage puller suspending the laterally movable vehicle supporting platform;

FIG. 15 is a longitudinally sectioned side elevation of a pusher and a depressed plate of the puller;

FIG. 16 is a longitudinally sectioned side elevation of a self-propelled drive and the puller of the carriage suspending the laterally movable vehicle supporting platform;

FIG. 17 is an overall front elevation of a modification using a laterally movable carriage type of vehicle supporting platform;

FIG. 18 is an overall front elevation of a modification, in which a positioner means is dedicated for respective vertically movable vehicle supporting platforms;

FIG. 19 is an overall plan view of the positioning means;

FIGS. 21 to 31 show a second embodiment of a parking apparatus according to the present invention, in which FIG. 21 is an overall front elevation of the apparatus in which one of the vertically movable vehicle supporting platforms is lowered to the lower vehicle supporting level;

FIG. 22 is a partly cut-out side elevation of the entire apparatus;

FIG. 23 is a plan view of a partly cut-out side elevation of the overall apparatus;

FIG. 24 is a longitudinal rear elevation of a lifting guide and a suspended structure of the vertically movable vehicle supporting platform and a free end structure of a wire rope;

FIG. 25 is a perspective schematic view showing the lifting drive of each vertically movable vehicle supporting platform;

FIG. 26A is a partial side elevation in longitudinal cross-section of a winding rotary body in the lifting drive;

FIG. 26B is a partial front elevation in longitudinal cross-section of the winding rotary body in the lifting drive;

FIG. 27 is a partly cut-out plan view of the laterally movable vehicle platform;

FIG. 28 is a partly cut-out side elevation of the laterally movable vehicle platform;

FIG. 29 is an overall front elevation of a modification, in which a positioner is dedicated to each vertically movable vehicle supporting platform;

FIG. 30 is a plan view of a receiver for each vertically movable vehicle supporting platform; and FIG. 31 is an overall front elevation of a modification, in which the vertically movable vehicle supporting platform is in an underground pit.

DETAILED DESCRIPTION

Figure 1:
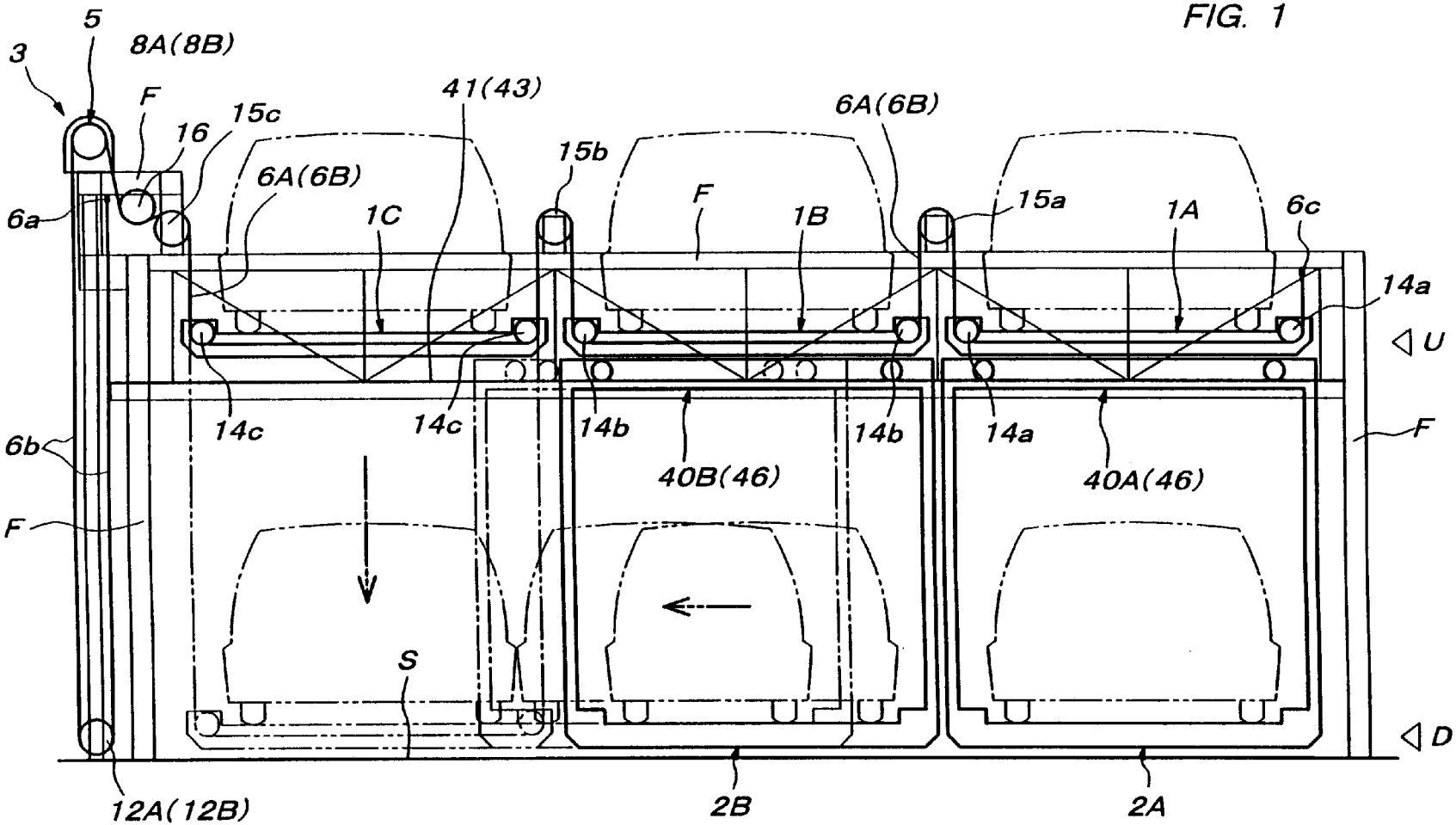
Figure 1A:
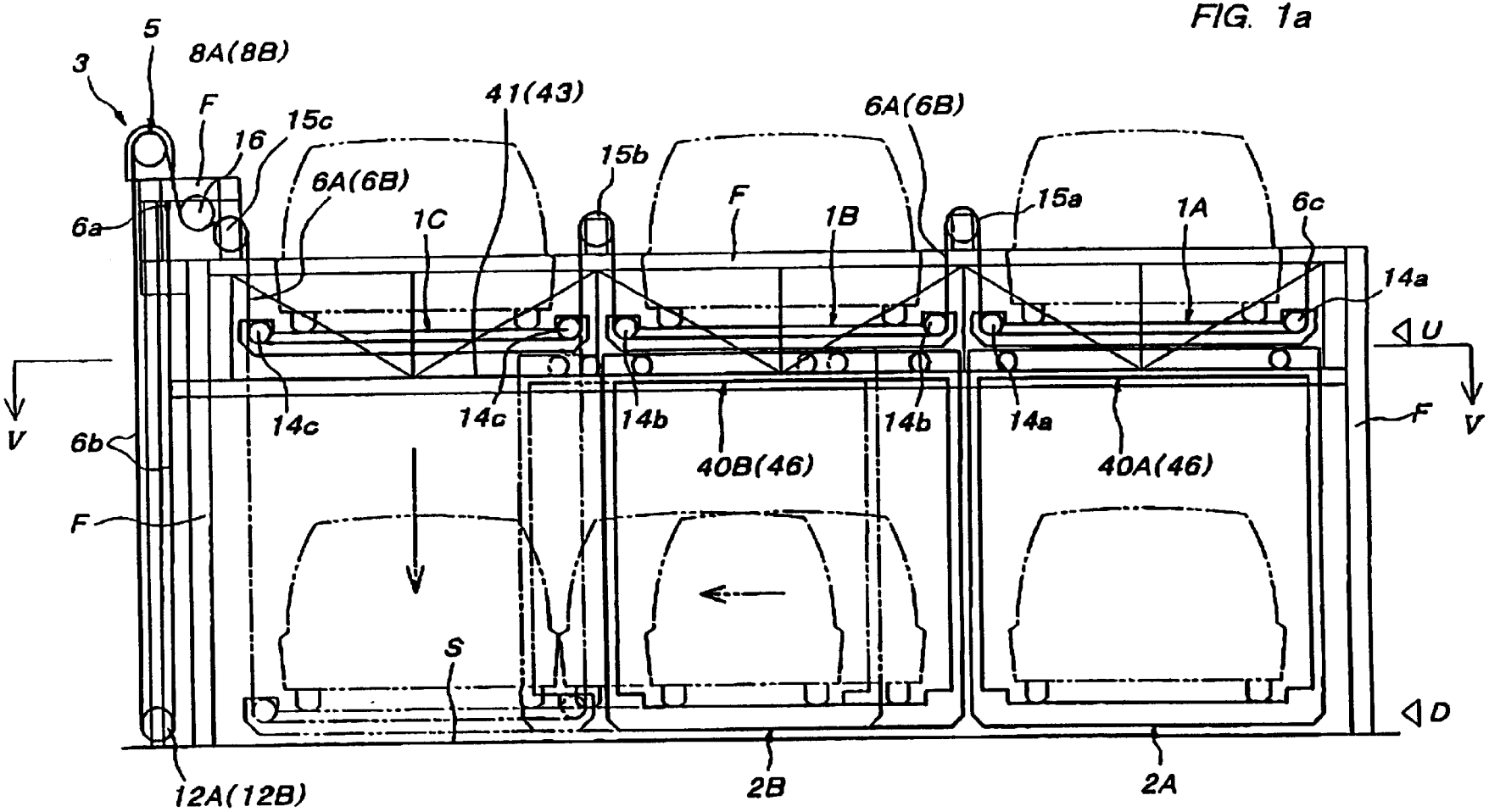
Figure 2:
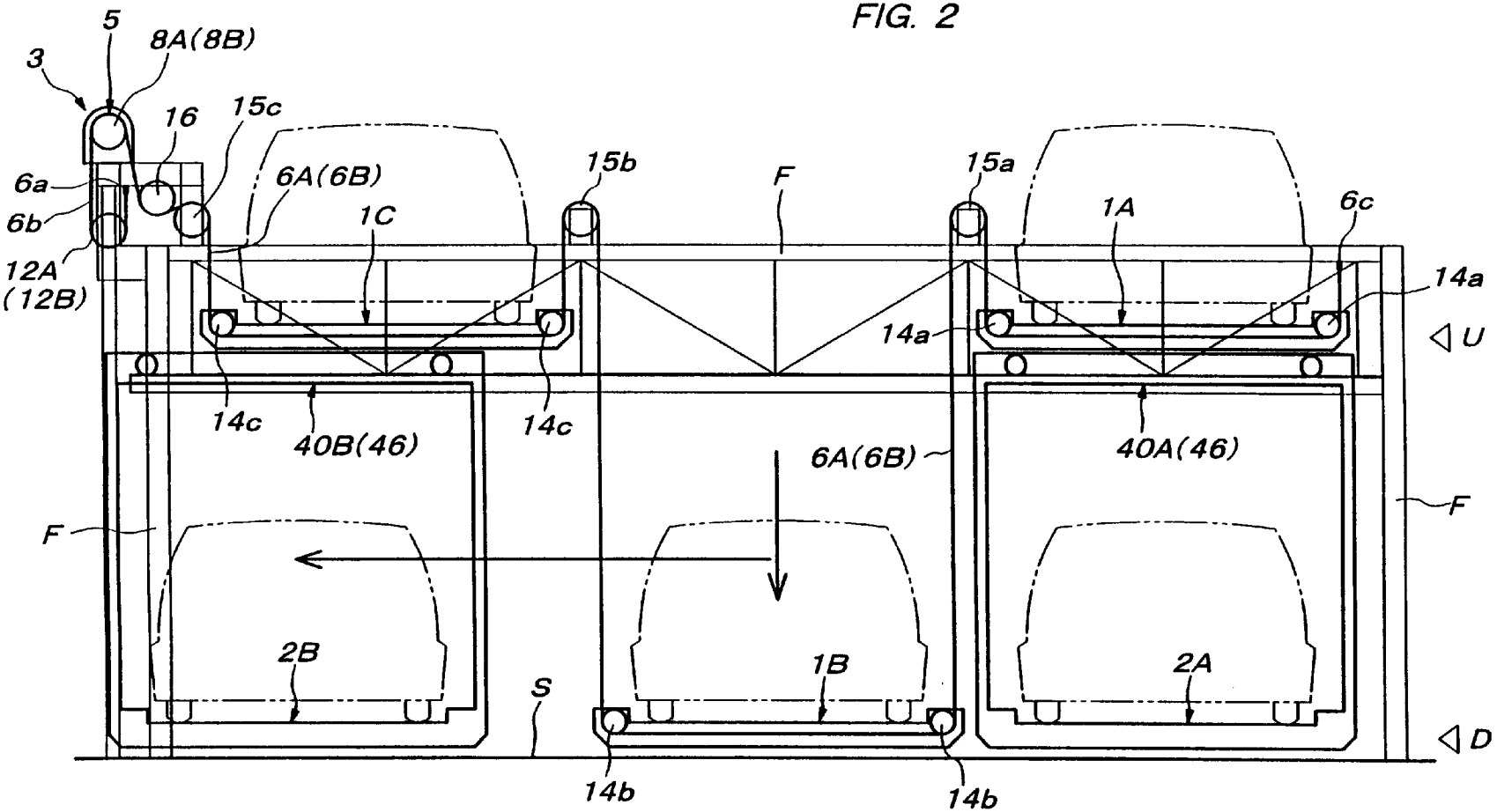
Figure 3:
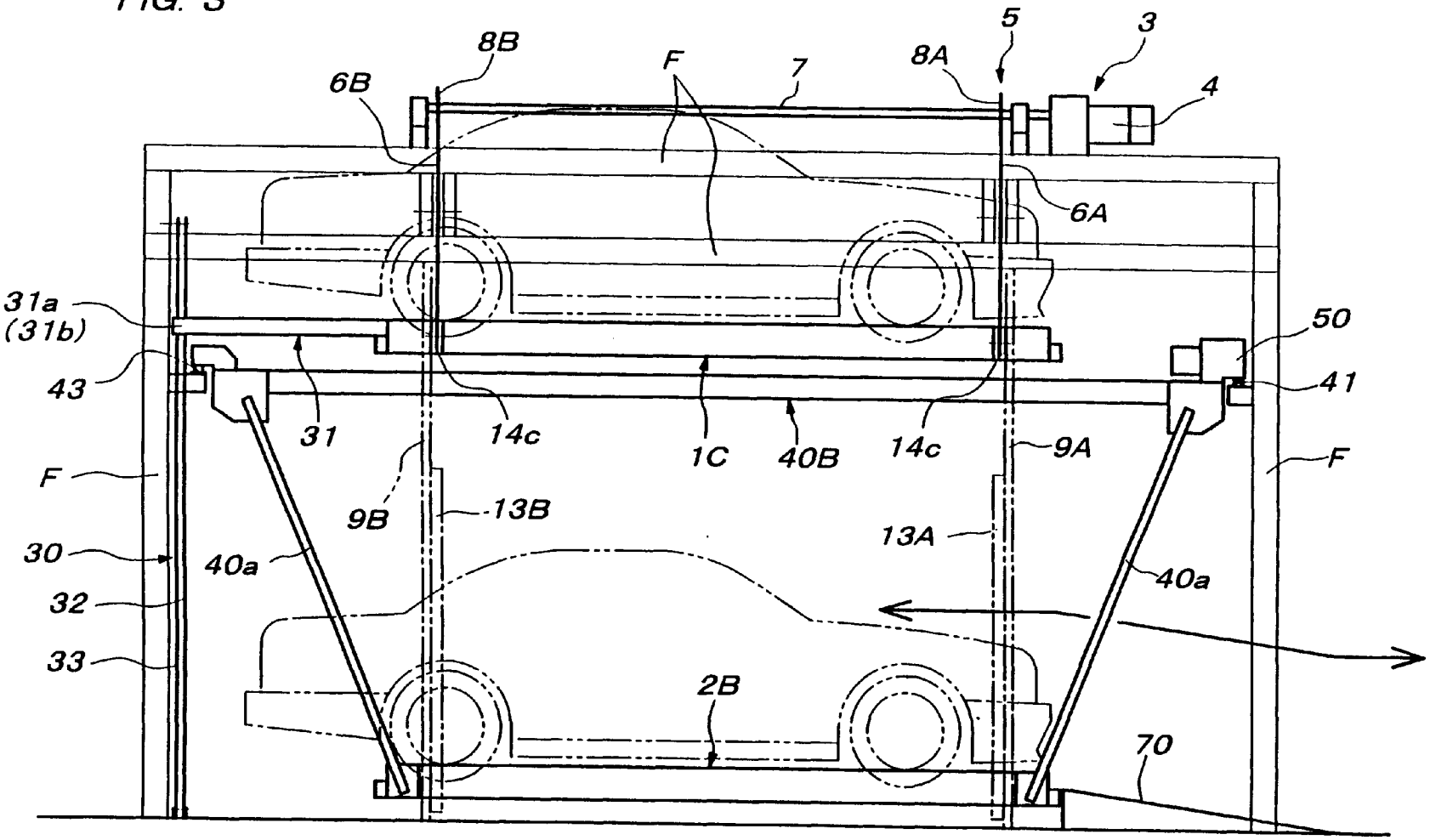
Figure 3A:
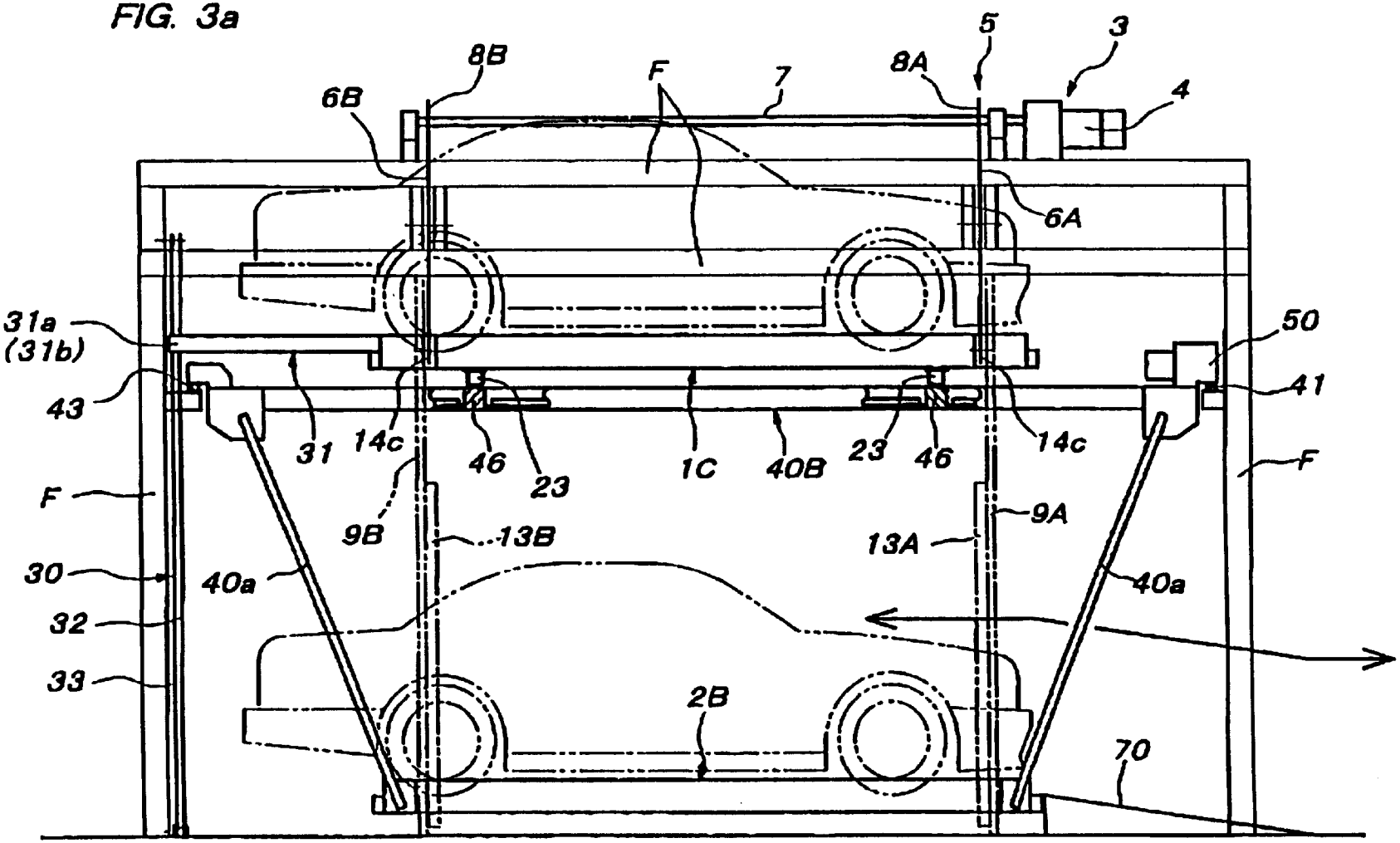

The first embodiment of a parking apparatus according to the present invention is shown in FIGS. 1 to 20. In FIGS. 1 to 3, each of vertically movable vehicle supporting platforms 1A to 1C can be lifted and lowered between an upper vehicle supporting level U and a lower vehicle supporting level D, independently of each other. The vertically movable vehicle supporting platforms 1A to 1C are horizontally arranged parallel to each other. Laterally movable vehicle supporting platforms 2A and 2B are one less in number than the number of the vertically movable vehicle supporting platform 1A to 1C. The laterally movable vehicle supporting platforms 2A and 2B are movable perpendicularly to the direction parallel of the vertically movable vehicle supporting platforms 1A to 1C. A lifting drive 3 is provided for the vertically movable vehicle supporting platforms 1A to 1C.

The lifting drive 3 of each of the vertically movable vehicle supporting platforms 1A to 1C has a hoist 5 driven by one motor 4 with a brake and front and rear pairs of suspending cables (chains) 6A and 6B used for extraction and retraction by the hoist 5. As shown in FIGS. 4, 6 to 9, the hoist 5 has a drive shaft 7 supported in the back and the front on a frame F at the top on the outside on one end of the parallel arrangement of the vertically movable vehicle supporting platforms. The drive shaft 7 is cooperatively coupled with the motor 4 with the brake at one end, with driving sprockets 8A and 8B being mounted on the front and rear ends of the drive shaft 7. The meter 4 also rotates a lower, vertically movable shaft 11 having guide rollers 10A and 10B loosely engaged with vertical guide rails 9A and 9B on both ends, and vertically movable sprockets 12A and 12B supported on the lifting shaft 11 at a position directly below the driving chain pinions 8A and 8B.

The two suspending cables (chains) 6A and 6B are wound around the respective driving sprockets 8A and 8B. One ends at 6*a* on the side of the driving chain sprockets 8A and 8B and attached to the frame F directly below the driving chain sprockets 8A and 8B. The vertically movable driving chain sprockets 12A and 12B are suspended on vertical portions 6B between the attached one ends 6*a* and the driving chain sprockets 8A and 8B.

As shown in FIG. 1 the other ends of the suspending cables (chains) 6A and 6B are attached to at 6*c* to the frame F at upper positions on the end of the frame remote from the driving sprockets 8A and 8B of the parallel vertically movable vehicle supporting platforms as 1A to 1C (at the inside of the vehicle supporting platform 1B opposed to the side next to the platform 2B. Portions of the cables (chains) between the ends 6*c* and the driving sprockets 8A and 8B are wound around supporting guide wheels 14*a* to 14*c* rotatably supported from both sides of the front and the rear of the vertically movable vehicle supporting platforms 1A to 1C and front and rear stationary guide wheels 15*a* to 15*c* respectively supported on the top of the frame between the vertically movable vehicle supporting platforms 1A and 1B, and between the vertically movable vehicle supporting platforms 1B and 1C in rotatable fashion, in a zig-zag fashion to suspend both the front and rear ends of the vertically movable vehicle supporting platforms 1A to 1C.

Figure 6:
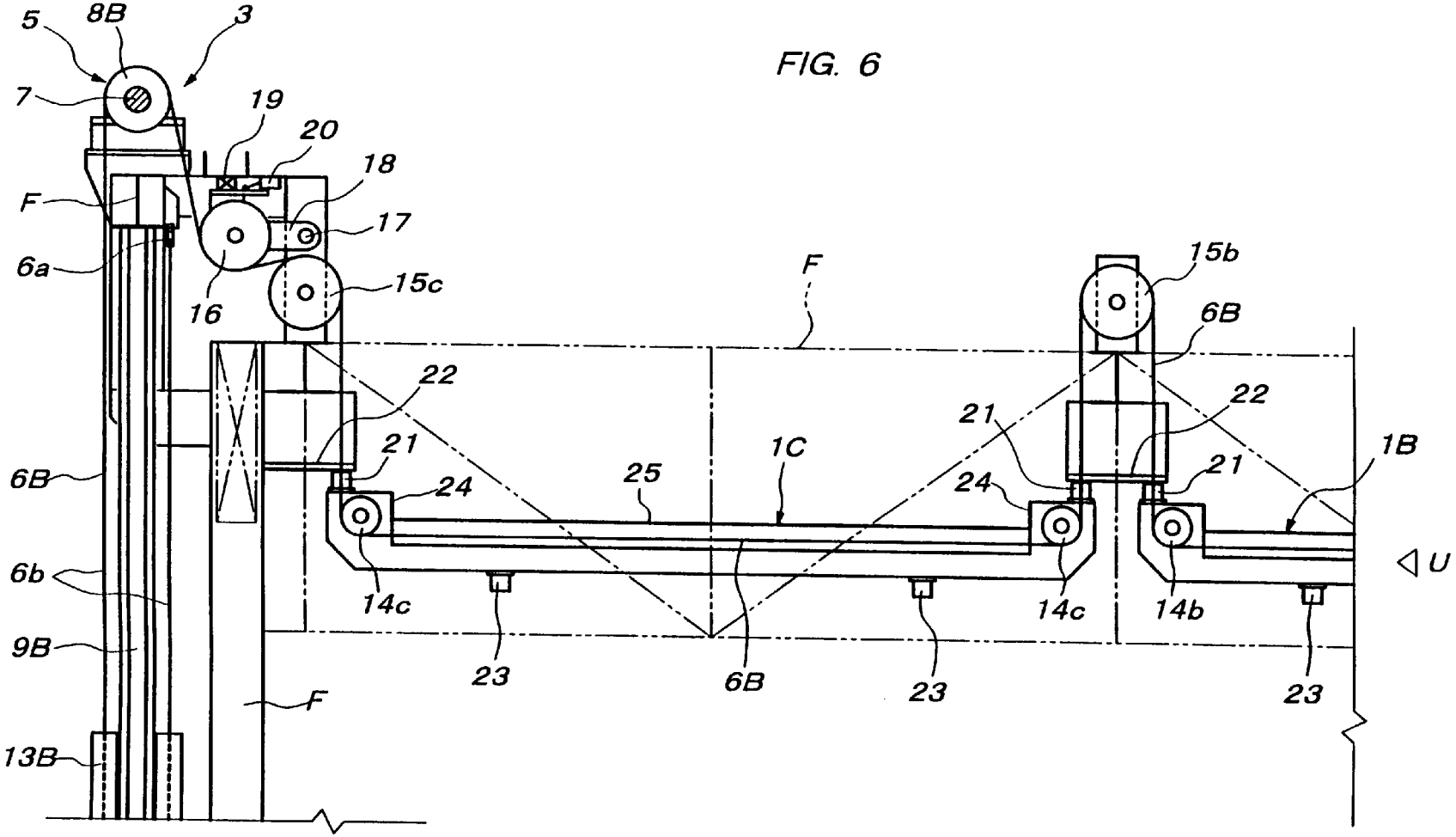
Figure 7:
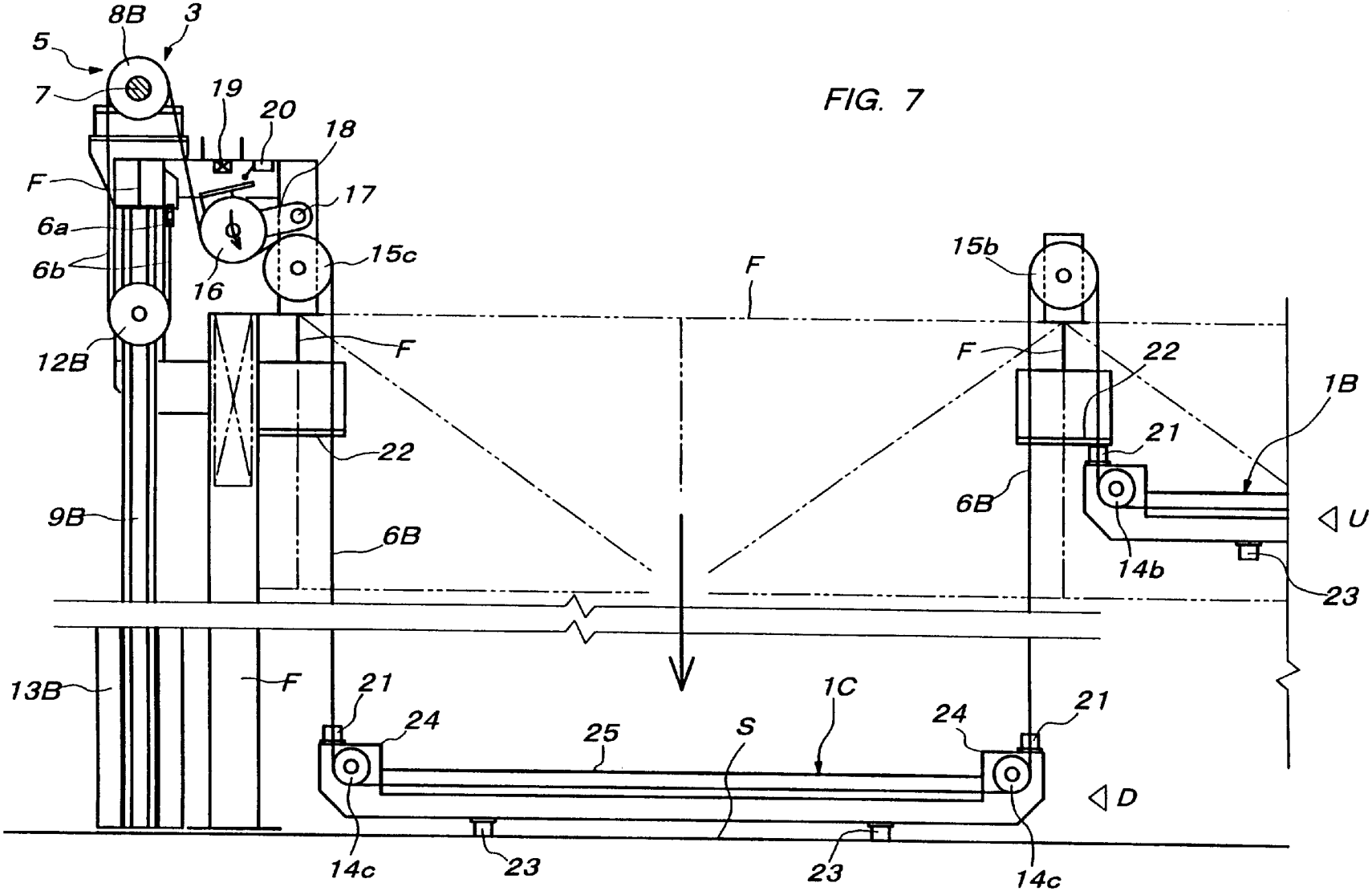

As shown in FIGS. 6 and 7, front and rear stationary guide wheels 15*c* and the driving chain sprockets 8A and 8B, the lifting cables (chains) 6A and 6B are wound around front and rear vertically rockable free guide wheels 16. Respective free guide wheels 16 are rotatably supported on free ends of front and rear rocking arms 18 rotatably supported on the frame for vertical rocking motion about respective support shafts 17. A limit switch 20 is provided for detecting when each rocking arm 18 is in contact with an upper motion limit stopper 19 on the side of the frame F and when the rocking arm 18 is tilted downwardly away from the upper motion limit stopper 19.

As shown in FIGS. 6 and 7, when respective vertically movable vehicle supporting platforms 1A to 1C are at the upper vehicle supporting level U (upper limit position), a contact member 21 provided at four positions around the upper side of the respective vertically movable vehicle supporting platforms 1A to 1C contacts the lower surface of an upper limit positioning member 22 of the vertically movable vehicle supporting platform on the side of the frame F. A contact member 23 is provided on the bottom of respective vertically movable vehicle supporting platforms 1A to 1C, and contacts a floor surface S when the vertically movable vehicle supporting platforms 1A to 1C are located at the lower vehicle supporting level D (lower limit position). On the other hand, as shown in FIGS. 6 and 7, suspending guide wheels 14*a* to 14*c* on the sides of the respective vertically movable vehicle supporting platforms 1A to 1C are rotatably mounted on the inside of a frame portion 24 on the rising left and right side edges of the vertically movable vehicle supporting platforms 1A to 1C. The suspending cables 6A and 6B between the left and right suspending guide wheels 14*a* to 14*c* extend through the bottom of a floor 25 forming a vehicle supporting plane of the vertically movable vehicle supporting platforms 1A to 1C.

Figure 10:
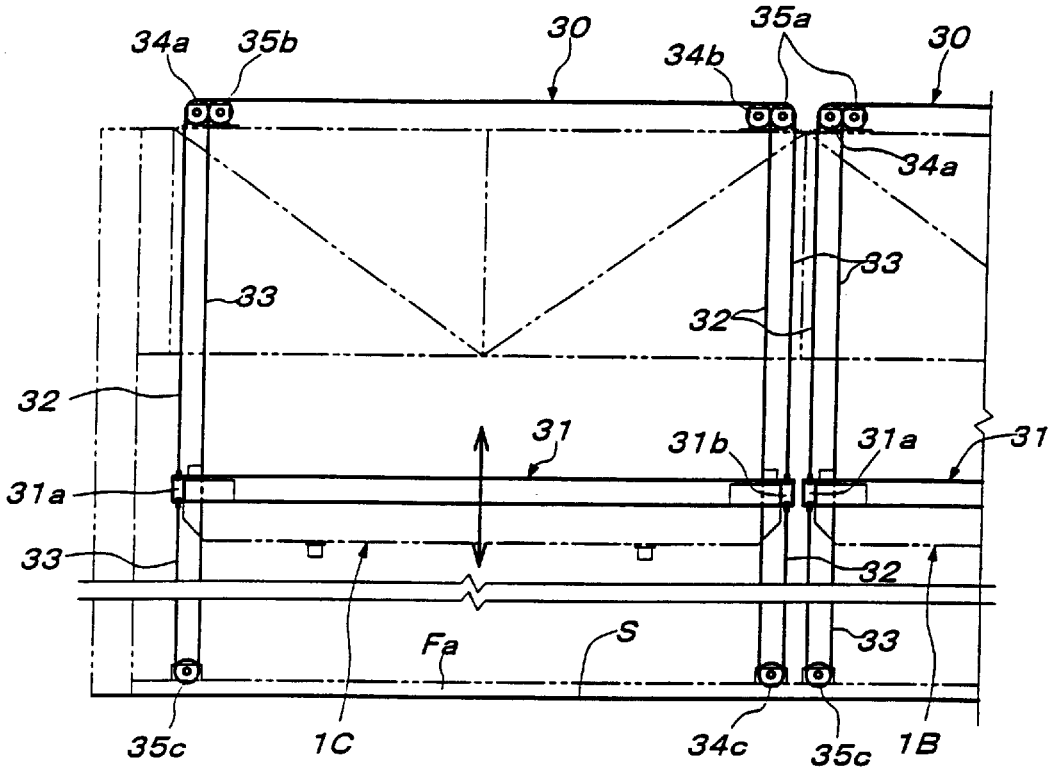
Figure 11:
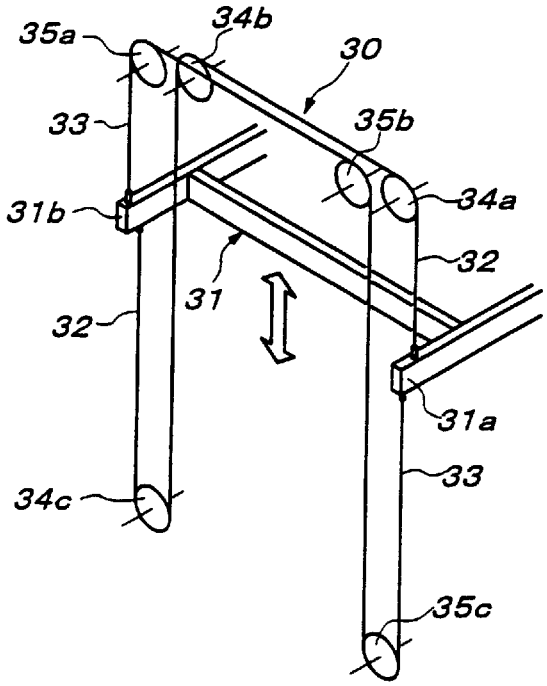

As shown in FIGS. 3, 4, 10 11 and 13, front-to-back tilt preventers 30 are provided in the respective vertically movable vehicle supporting platforms 1A to 1C for preventing tilting of respective vertically movable vehicle supporting platforms 1A to 1C in the direction of their parallel arrangement. The tilt preventers 30 have two linkage cables 32 and 33 with both of their ends attached to the rear ends of left and right sides 31*a* and 31*b* of the extending frame 31 extended rearwardly from the rear ends of the vertically movable vehicle supporting platforms 1A to 1C. One linkage cable 32 is wound around the guide wheels 34*a* and 34*b* rotatably supported from the top of the frame F, the end of the cable 32 being attached to the bottom of the rear right side 32*a* of the extended frame 31, and around the guide wheel 34*c* rotatably supported from the frame portion Fa laid on the floor surface S below the rear right side 31*b* of the extended frame 31, as shown in FIG. 11, to be pulled by lowering of the left edge of the vertically movable vehicle supporting platforms 1A to 1C thereby to pull down the right side edge of the vertically movable vehicle supporting platforms 1A to 1C. The other linkage cable 33 is wound around the guide wheels 35*a* and 35*b* rotatably supported from the frame F and the guide wheel 35*c* rotatably supported from the frame portion Fa laid on the floor surface S, the end of the cable 33 being attached to the bottom of the rear left side 31*b* of the extended frame 31, as shown in FIGS. 10 and 11.

As shown in FIGS. 1 to 3, 5, 12 and 13, the laterally movable vehicle supporting platforms 2A and 2B arranged in parallel to each other and movable against the parallel arrangement direction of the vertically movable vehicle supporting platforms in the lower vehicle supporting level D, are suspended at four corners by suspending struts or links 40*a* extended from carriages 40A and 40B, and located directly below the vertically movable vehicle supporting platforms 1A to 1C at the upper vehicle supporting level U at an angle to the vertical. Thus, the carriages 40A and 40B are supported from left and right grooved wheels 42 on positioning and supporting guide rail 41 mounted from the front part of the frame F, and are supported from left and right wheel units 44*a* and 44*b* on a rear support guide rail 43 mounted on the frame F. Thus, the laterally movable vehicle supporting platforms 2A and 2B are independently of each other laterally movable perpendicularly to the parallel arranged vertically movable vehicle supporting platforms.

Figure 5:
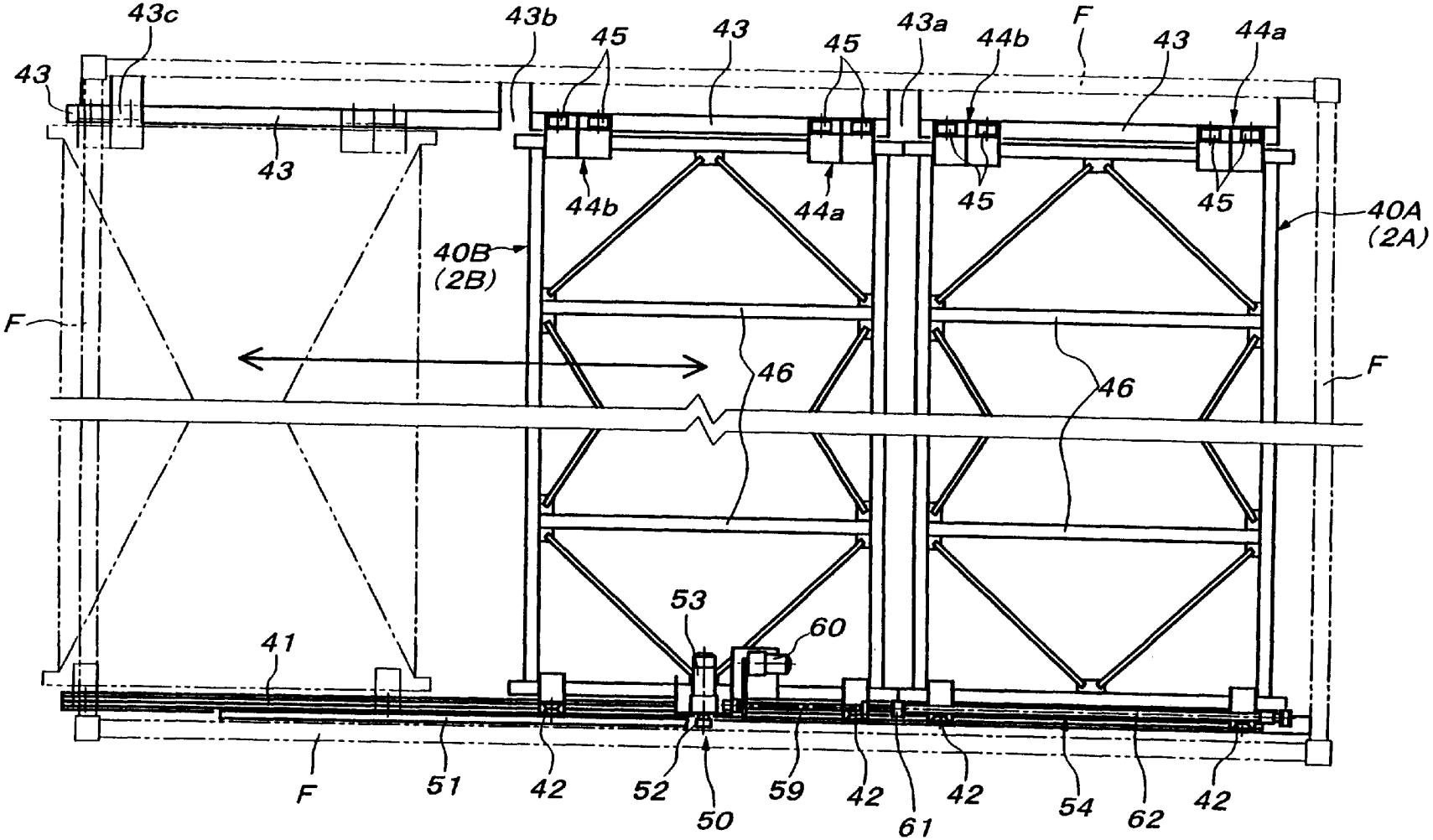
Figure 13:
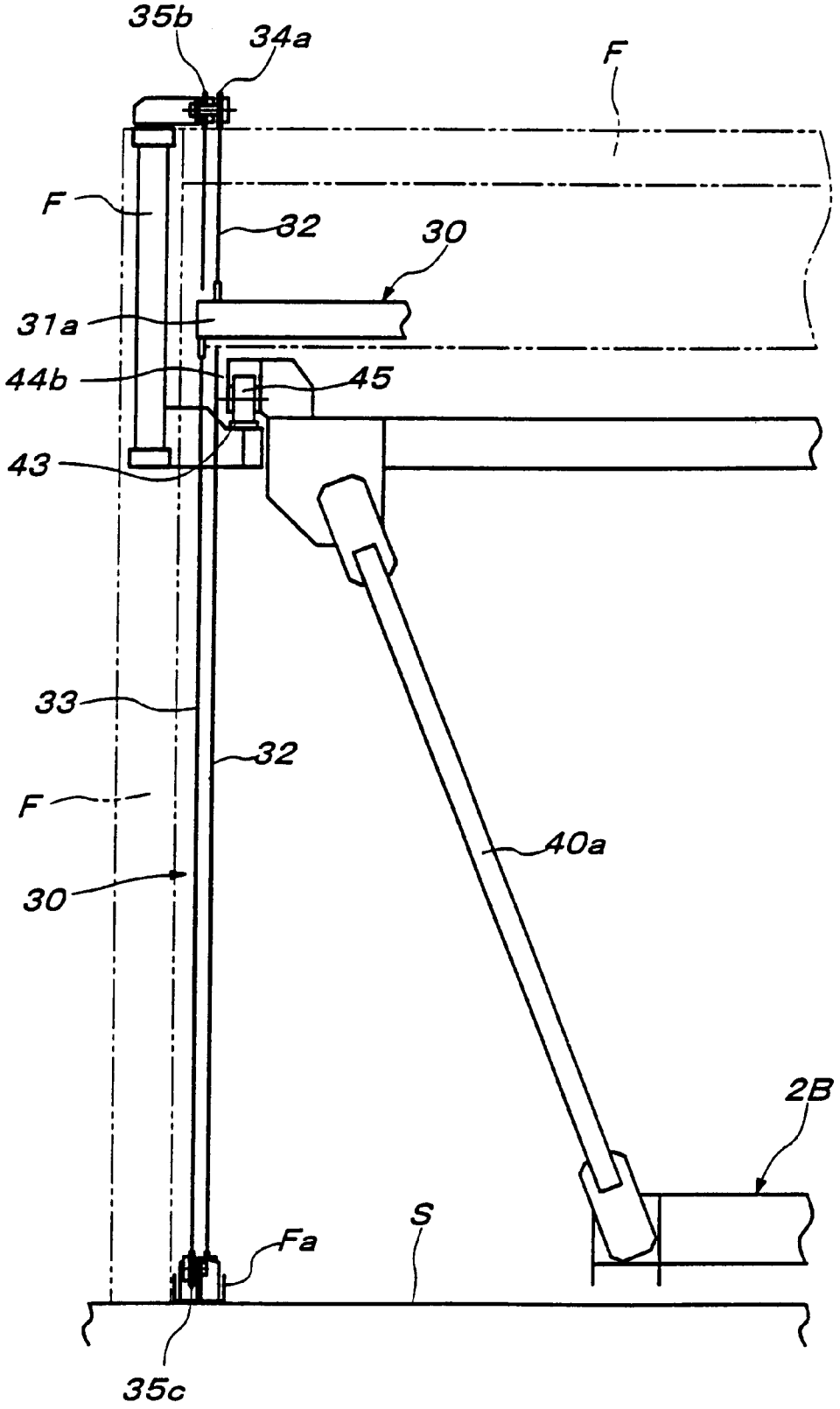
Figure 14:
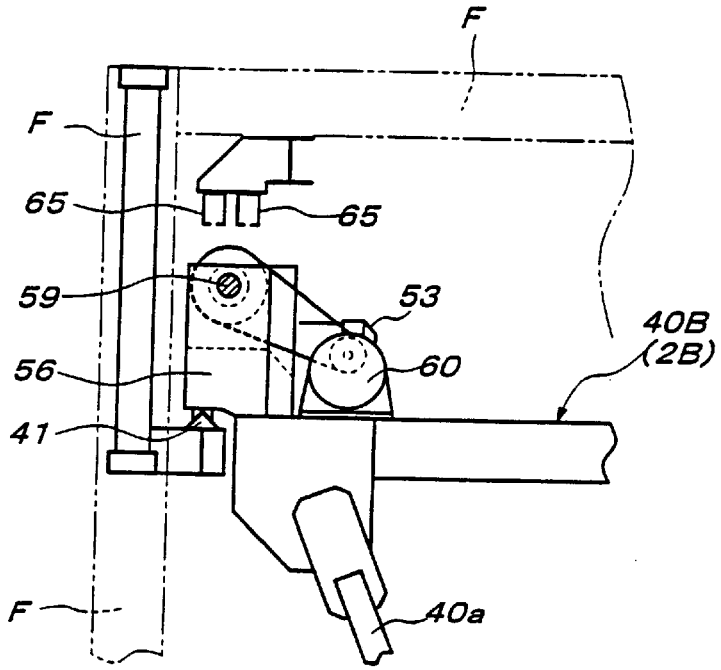

As shown in FIGS. 5 and 13, the rear supporting guide rail 43 at the rear ends of respective vertically movable vehicle supporting platforms 1A to 1C are divided at positions 43*a* to 43*c* where the rear left and right portions 31*a* and 31*b* of the extended frame 31 to which the linkage cables 32 and 33 are coupled. Accordingly, two wheels 45 are provided on the left and right wheel units 44*a* and 44*b* on the side of the supporting guide rail 43, with a distance between the wheels being greater than or equal to the space between the respective divided portions 43*a* to 43*c* so that the wheel units 44*a* and 44*b* cannot drop off the rail.

The carriages 40A and 40B suspending respective laterally movable vehicle supporting platforms 2A and 2B are provided with crosstraversing of the frame members 46 (see FIG. 5) by the contact members 23 (see FIG. 6) of the bottom portions of respective vertically movable vehicle supporting platforms 1A to 1C.

Figure 12:
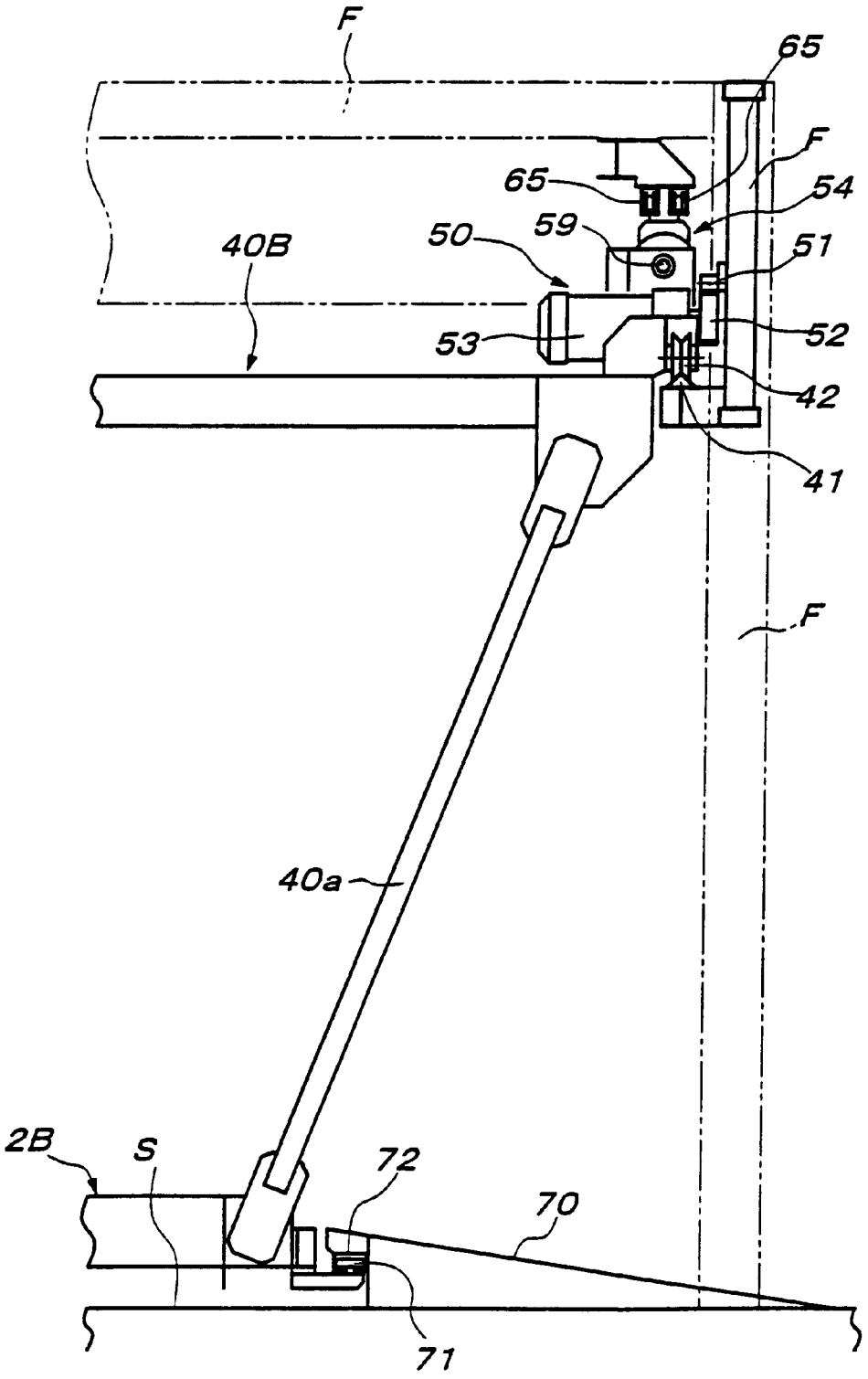
Figure 16:
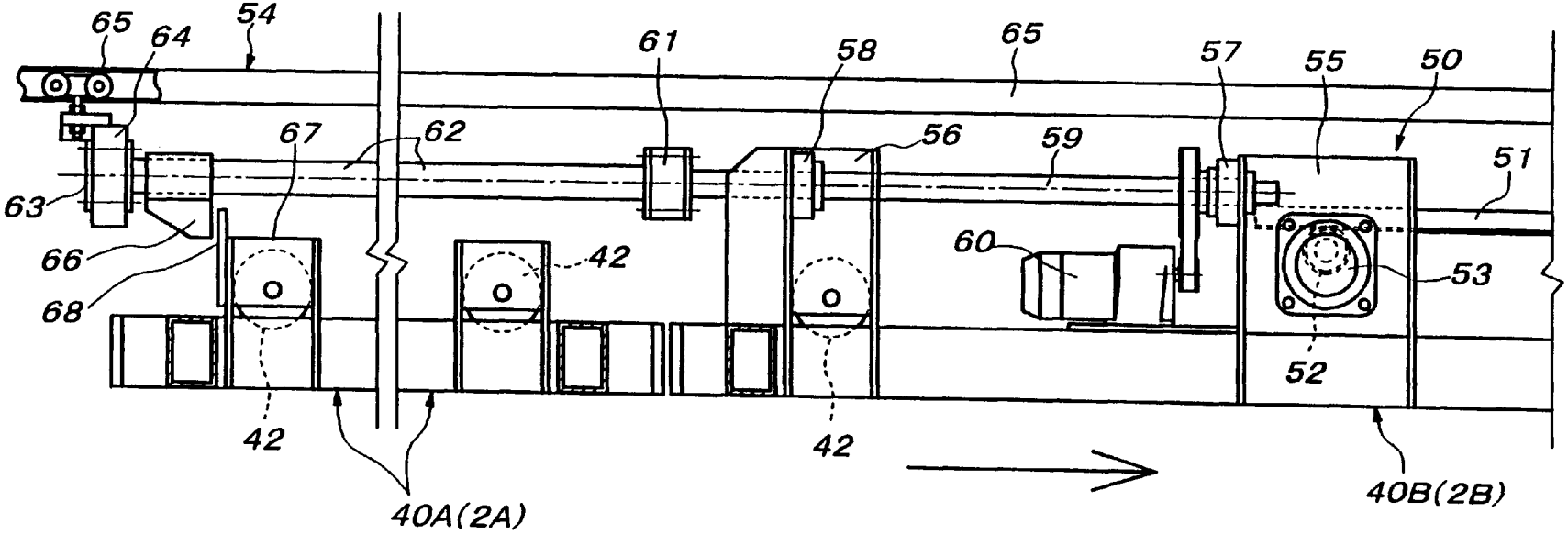

As shown in FIGS. 5, 12 and 16, a self-propelling drive 50 is provided between the laterally movable vehicle supporting platforms 2A and 2B with one of the laterally movable vehicle supporting platform 2B. The self-propelling drive 50 has a rack 51 of a length that covers the region of lateral motion of the laterally movable vehicle supporting platform 2B between the position directly below the vertically movable vehicle supporting platform 1B located at the center position and the position directly below the vertically movable vehicle supporting platform 1C on the side where the lifting drive 3, is mounted on the frame F, so that the rack 51 can be located adjacent the front end of the carriage 40B. A meter 53 with a brake is mounted on the front part of the carriage 40B suspending the laterally movable vehicle supporting platform 2B. The meter 53 lines an output shaft with a pinion gear 52 thereon meshing with the rack 51.

Figure 15:
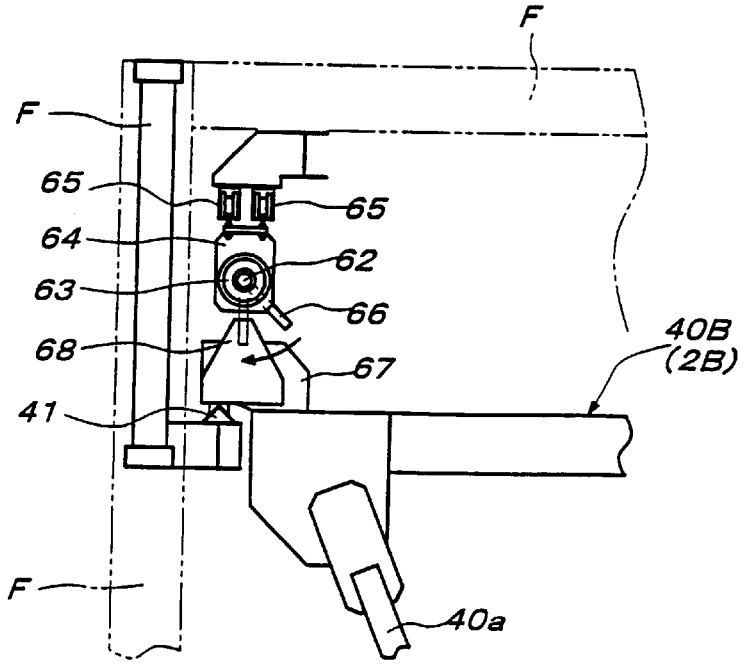

The laterally movable vehicle supporting platform 2B that has the self-propelled drive 50 for lateral motion, also has a puller 54 for the vertically movable vehicle supporting platform 1A (carriage 40A). As shown in FIGS. 5 and 14 to 16, the puller 54 has a rotary shaft 59 supported from a motor supporting frame 55 that supports the motor 53 of the carriage 40B, and a wheel supporting frame 56 rotatably supporting a grooved wheel 42 adjacent to the carriage 40A at both ends and also supported by respective bearings 57 and 58, and driven by a motor 60 with a brake. The motor 60 drives the rotary shaft 59, a rotary shaft 62 having a length substantially the same as the width in the direction of lateral motion of the carriage, and being coaxially connected to the rotary shaft 59 by a shaft coupling 61 at one end. A trolley 64 suspends at the free end of the rotary shaft 62 through a support bearing 63, from a trolley guide rail 65 mounted on the frame F supporting the trolley 64 for movement in the direction of lateral motion of the carriage. As shown in FIGS. 15 and 16, a pusher 66 is mounted for rotation and pushing the rear free end of the rotary shaft 62, and an abutment plate 68 for the pusher is mounted on a wheel supporting frame 67 of the carriage 40A adjacent to the side of the carriage 40B. Thus, as shown in FIG. 15, the pusher 66 has a projection disposed at a predetermined angle and does not engage the plate 68 when the rotary shaft is at an initially stopped phase.

Figure 4:
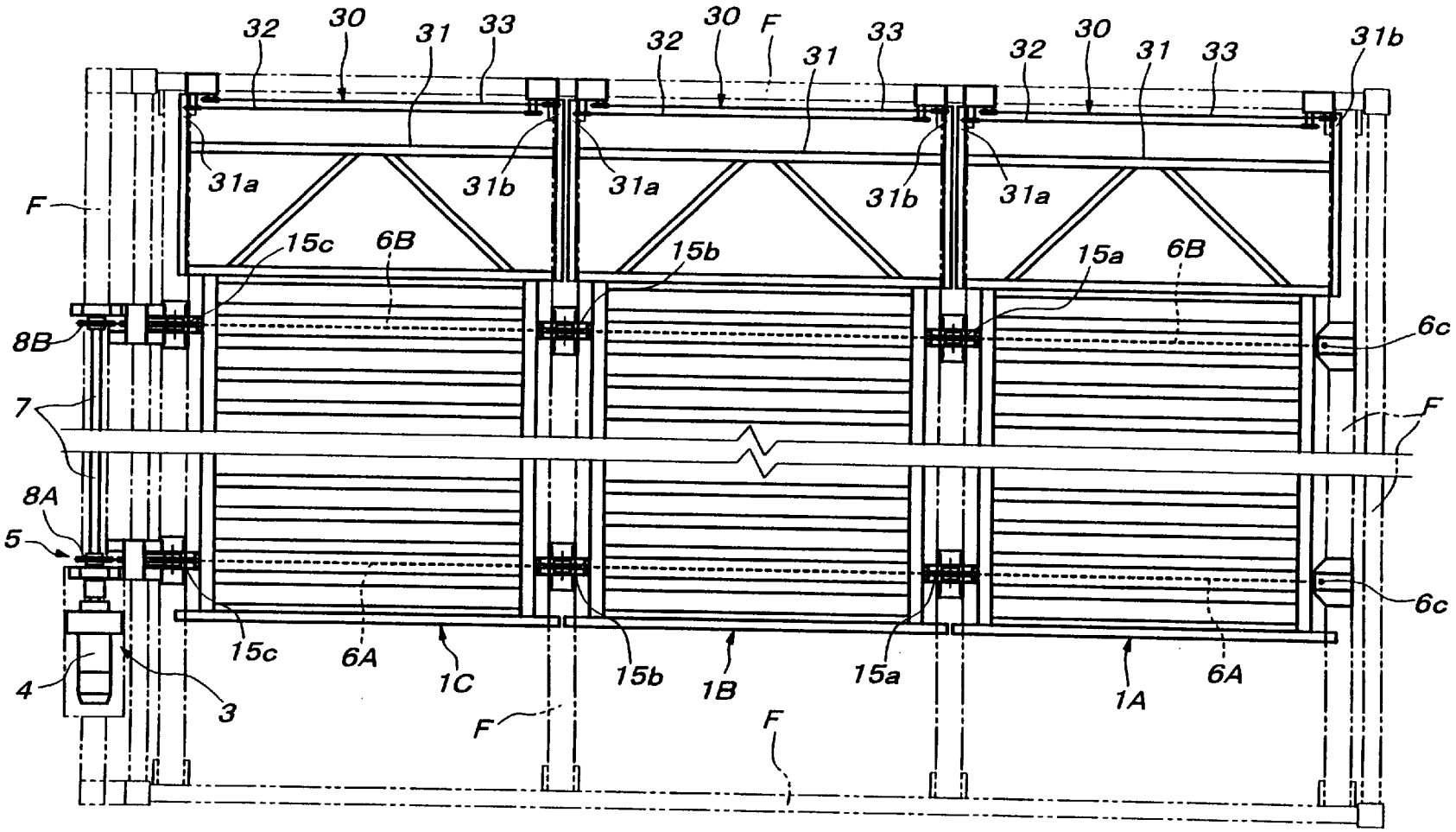

In the parking apparatus of the embodiment described above, when the motor 4 of the lifting drive 3 of the vertically movable vehicle supporting platforms 1A to 1C shown in FIGS. 3 and 4 is driven in the lifting direction of the suspending cables (chains) 6A and 6B of the driving sprockets 8A and 8B, the lifting cables 6A and 6B between the end portion 6*c* attached to the frame F and the driving sprockets 8A and 8B, shown in FIG. 1, are pulled by the driving sprockets 8A and 8B to lift the vertically movable vehicle supporting platform 1A supported by the suspending cables 6A and 6D between the ends 6*c* and the stationary guide wheel 15*a*, the vertically movable vehicle supporting platform 1B suspended by the suspending cables 6A and 6B between the stationary guide wheels 15*a* and 15*b*, and the vertically movable vehicle supporting platform 1C suspended by the suspending cables 6A and 6B between the stationary guide wheels 15*b* and 15*c*.

Figure 8:
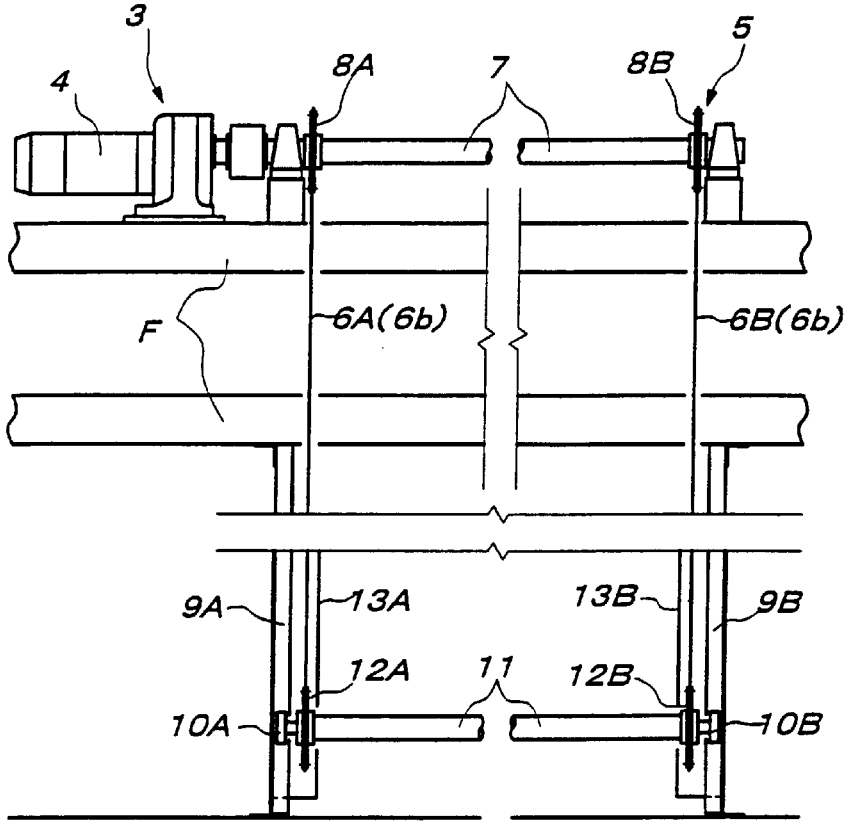
Figure 9:
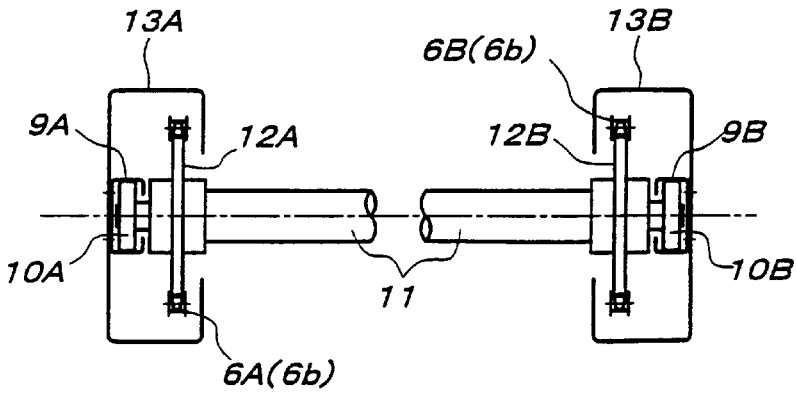

As shown in FIGS. 8 and 9, the lifting sprockets 12A and 12B engaging the lower end of the vertical portion 6*b* of the suspending cables 6A and 6B extending from the driving sprockets 8A and 8B are lowered as guided by the vertical guide rails 9A and 9B. As shown in FIG. 6, the rockable free guide wheel 16 engaging with the suspending cables 6A and 6B, are pulled by tension of the suspending cables 6A and 6B. Thereupon, the rocking arm 18 rotatably supporting the free guide wheel 16, contacts the upper motion limit stopper 19. This condition is detected by the limit switch 20.

Then, as shown by the solid line in FIG. 1, when all of the vertically movable vehicle supporting platforms 1A to 1C reach the upper vehicle supporting level U and thus the contact members 21 on the upper sides of the respective vertically movable vehicle supporting platforms 1A to 1C abut against the lower surfaces of the upper limit positioning members 22 of the vertically movable vehicle supporting platforms, the lifting cables 6A and 6B come to be wound up further. Since the lifting sprockets 12A and 12B lowered by the lifting up of the vertically movable vehicle supporting platforms 1A to 1C, reach their lower limit position shown in FIG. 1, the motor 4 can be automatically stopped by using a detection signal of a detector detecting the lower limit position of the lifting sprockets 12A and 12B shown in FIG. 1, and in conjunction therewith, a brake can be applied to lock the driving sprockets 8A and 8B. Thus, the vertically movable vehicle supporting platforms 1A to 1C are fixed in the upper vehicle supporting level U.

As shown by the solid line in FIG. 1, when all of the vertically movable vehicle supporting platforms 1A to 1C are fixed at the upper vehicle supporting level U, there is a slight gap to permit lateral motion of the laterally movable vehicle supporting platforms 2A and 2B between the contact members 23 on the bottoms of respective vertically movable vehicle supporting platforms 1A to 1C (see FIG. 6) and the supporting plate for traversing frame member 46 (see FIG. 5) of the vehicle supporting platforms of the carriages 40A and 40B suspending the laterally movable vehicle supporting platforms 2A and 2B below the vertically movable vehicle supporting platforms 1A to 1C.

As shown in FIG. 2, when the only laterally movable vehicle supporting platform 2B located directly below the vertically movable vehicle supporting platform 1B is moved laterally to the position directly below the vertically movable vehicle supporting platform 1C to permit lowering the vertically movable vehicle supporting platform 1B, the pinion 52 is driven to rotate forward by the motor 53 of the self-propelling drive 50 of the laterally movable vehicle supporting platform 2B when the pusher 66 of the pulling means shown in FIG. 16 does not engage with the abutment plate 68 of the laterally movable vehicle supporting platform 2A (carriage 40A). The carriage 40B suspending the laterally movable vehicle supporting platform 2B is moved laterally to the position directly below the vertically movable vehicle supporting platform 1C on the supporting guide rail 43 by the force generated by the pinion 52 acting on the rack 51 on the side of the frame F, for positioning the front left and right grooved wheels 42, the rear supporting guide rails, and left and right wheel units 44*a* and 44*b* (four wheels 45).

When two laterally movable vehicle supporting platforms 2A and 2B located directly below the vertically movable vehicle supporting platforms 1A and 1B for lowering the vertically movable vehicle supporting platform 1A to the position directly below the vertically movable vehicle supporting platforms 1B and 1C, the rotary shafts 59 and 62 of the puller 54 shown in FIG. 16 rotate by a predetermined angle driven by the motor 60 to switch the pusher 66 shown by broken line in FIG. 15 to the active position engaging the abutment plate 68 of the laterally movable vehicle supporting platform 2A (carriage 40A). Thereafter, when the self-propelling drive 50 of the laterally movable vehicle supporting platform 2B is moved laterally, the laterally movable vehicle supporting platform 2B to the position directly below the vertically movable vehicle supporting platform 1C. The pusher 66 at the rotary shafts 59 and 62 integrally moved with the laterally movable vehicle supporting platform 2B pushes the laterally movable vehicle supporting platform 2A through the abutment plate 68 being engaged by the pusher 66 when its free end is suspended from the trolley guide rail 65 by a trolley 64. When the laterally movable vehicle supporting platform 2B reaches the position directly below the vertically movable vehicle supporting platform 1C, the laterally movable vehicle supporting platform 2A also reaches the position directly below the vertically movable vehicle supporting platform 1B.

When two laterally movable vehicle supporting platforms 2A and 2B are located directly below the vertically movable vehicle supporting platforms 1B and 1C, a space directly below the vertically movable vehicle supporting platform 1A is unoccupied, and when the vacant space is changed to directly below the vertically movable vehicle supporting platform 1B to permit lowering the vertically movable vehicle supporting platform 1B at the center position, this requires only that laterally movable vehicle supporting platform 2A be moved laterally to the position directly below the vertically movable vehicle supporting platform 1A. However, since the self-propelling drive 50 is not provided in the laterally movable vehicle supporting platform 2A, the laterally movable vehicle supporting platform 2B is at first laterally moved to the position directly below the vertically movable vehicle supporting platform 1B at the center position by the self-propelling drive 50. At this time, the carrier 40B suspending the laterally movable vehicle supporting platform 2B directly pushes the carrier 40A suspending the laterally movable vehicle supporting platform 2A. Therefore, the laterally movable vehicle supporting platform 2A is pushed by the laterally movable vehicle supporting platform 2B, moving it laterally to the position directly below the vertically movable vehicle supporting platform 1A. Subsequently, as set forth above, where the pusher 66 of the puller 54 is in an initial position not engaging the depressed plate 68 of the laterally movable vehicle supporting platform 2A (carriage 40A), only laterally movable vehicle supporting platform 2B is moved laterally to the position directly below the vertically movable vehicle supporting platform 1C by the self-propelling drive 50.

As set forth above, the space among the vertically movable vehicle supporting platforms 1A to 1C located at the upper vehicle supporting level U can be switched to the position directly below any arbitrary vertically movable vehicle supporting platform to insert or to remove a vehicle. Subsequently, when it is the objective to insert or to remove a vehicle on the upper vehicle supporting level U, the vertically movable supporting platform is lowered to the lower vehicle supporting level D. Upon lowering any one of the vertically movable vehicle supporting platforms 1A to 1C, the motor 4 of the lifting drive 3 is operated to drive the driving sprockets 8A and 8B in the direction for pulling the suspending cables 6A and 6B. As a result, the suspending cables 6A and 6B that suspend respective vertically movable vehicle supporting platforms 1A to 1C are pulled by the driving sprockets 8A and 8B. Thus, the respective vertically movable vehicle supporting platforms 1A to 1C start to become lowered by their own weight. However, in this case, two of the vertically movable vehicle supporting platforms 1A to 1C located directly above the laterally movable vehicle supporting platforms 2A and 2B cannot be lowered from the upper vehicle supporting level U since the contact members 23 (see FIG. 6) on their lower side contact the crossframe 46 (see FIG. 5) of the vehicle supporting platform of the carriages 40A and 40B suspending respective laterally movable vehicle supporting platforms 2A and 2B directly therebelow, and are received by the laterally movable vehicle supporting platforms 2A and 2B (carriages 40A and 40B) below.

When it is the objective to move a vehicle in or out of the vertically movable vehicle supporting platform 1C when it is not received by the laterally movable vehicle supporting platforms 2A and 2B (the vertically movable vehicle supporting platform 1C in FIG. 1, and vertically movable vehicle supporting platform 1B in FIG. 2), for example, the vertically movable vehicle supporting platform 1C is lowered by pulling on the suspending cables 6A and 6B to be lowered to the lower vehicle supporting level to be in the same way as the laterally movable vehicle supporting platforms 2A and 2B. The vertically movable vehicle supporting platform 1C lowered to the lower vehicle supporting level D is supported by the floor surface S by abutting the contact member 23 on the lower side against the floor surface S.

Accordingly, the suspending cables 6A and 6B are relaxed by pulling at them. Therefore, as shown in FIG. 7, the rockable free guide wheel 16 is lowered by gravity (or with the assistance of a spring). The rocking arm 18 is then released from the upper limit stopper 19 and the limit switch 20 detects this condition. On the other hand, vertical portion 6*b* of the suspending cables 6A and 6B are pulled up by the sprockets 8A and 8B, the lifting sprockets 12A and 12B, and the vertically movable shaft 11 are moved upwardly as guided by the vertical guide rails 9A and 9B. Therefore, the motor 4 can be automatically stopped using the detection signal of the detector detecting the lifting sprockets 12A and 12B reaching the upper limit position and the signal of the limit switch.

As set forth above, by lowering one of the vertically movable vehicle supporting platforms 1A to 1C for inserting and removing the vehicle, the vehicle can be inserted or removed from the vertically movable vehicle supporting platform.

Thus, the vertically movable vehicle supporting platforms 1A to 1C suspended at two front and rear portions by suspending cables 6A and 6B, can be lifted up without any possibility of tilting in the forward and back directions as long as the extracting and retracting speeds of both suspending cables 6A and 6B are the same. On the other hand, since the two linkage cables 32 and 33 of the tilt preventers 30 force synchronization of the lifting motion of the rear left and right end portions 31*a* and 31*b* of the vertically movable vehicle supporting platforms 1A to 1C (extending frame 31). Therefore, the vertically movable vehicle supporting platforms 1A to 1C will never tilt left or right. Thus, the vertically movable vehicle supporting platforms 1A to 1C can be lifted and lowered while maintaining a horizontal attitude.

When vehicles have been inserted or removed, as the case may be, in the vertically movable vehicle supporting platforms 1A to 1C, and are not lifted up to the upper vehicle supporting level U to place them in stand-by state at the lower vehicle supporting level for permitting insertion or removal of a vehicle until it becomes necessary to laterally move the laterally movable vehicle supporting platforms 2A and 2B for the purpose of insertion or removal of a vehicle. The reason is that two of the vertically movable vehicle supporting platforms 1A to 1C, directly below which the laterally movable vehicle supporting platforms 2A and 2B are located, are received by the carriages 40A and 40B suspending the laterally movable vehicle supporting platforms 2A and 2B and thus will not fall down. However, when one of the vertically movable vehicle supporting platforms 1A to 1C is not left below with the laterally movable vehicle supporting platform 2A and 2B, is not supported by a carriage of a laterally movable vehicle supporting platform and thus could possibly accidentally fall down, such as by a breakage of one of the suspending cables 6A and 6B.

Of course, it is also possible to lift the vertically movable vehicle supporting platform 1A to 1C when vehicle insertion or removal is completed, to the upper vehicle supporting level U directly thereafter to the extent to provide a path to permit a person to enter and exit for accessing to the vehicle on both laterally movable vehicle supporting platforms 2A and 2B, and then laterally to move only the laterally movable vehicle supporting platform 2B away from the laterally movable vehicle supporting platform 2A to receive both of the vertically movable vehicle supporting platforms 1B and 1C by the carriage 40B suspending the laterally movable vehicle supporting platform 2B. On the other hand, as shown in FIG. 2, the reason for moving the laterally movable vehicle supporting platform 2B away from the vertically movable vehicle supporting platform 1B beyond the position directly below the vertically movable vehicle supporting platform 1C, is to provide a path for entry and exit of the person between the laterally movable vehicle supporting platform 2B and the vertically movable vehicle supporting platform 1B in the lowered position. It should be noted that as shown in broken lines in FIG. 1, for the vertically movable vehicle supporting platform 1C lowered to the lower vehicle supporting level D, the frame F is constructed to provide a path for entry and exit of the person even on the opposite side of the laterally movable vehicle supporting platform 2B with respect to the vertically movable vehicle supporting platform 1C.

When a step that can affect transition appears between a vehicle supporting surface of the laterally movable vehicle supporting platform 2A and 2B and the vertically movable vehicle supporting platform 1A to 1C lowered to the lower vehicle supporting level D, and the floor surface, it is possible to provide a slope 70 for bridging a step between the front end of the laterally movable vehicle supporting platform 2A and 2B or the vertically movable vehicle supporting platform 1A to 1C lowered to the lower vehicle supporting level and the floor surface S for movement of the vehicle, as shown in FIGS. 3 and 12. In this case, as shown in FIG. 12, at the end on the side of the vehicle supporting platform of the vehicle transition slope 70, a rocking preventing roller 72 that is laterally movable in a direction of the lateral movement of the laterally movable vehicle supporting platform by engaging a roller 71 rotatably supported on a vertical shaft projected in the front end of the laterally movable vehicle supporting platforms 2A and 2B to prevent a rocking motion of the laterally movable vehicle supporting platforms 2A and 2B suspended from the carriages 40A and 40B.

In FIG. 3, with respect to respective laterally movable vehicle supporting platforms 2A and 2B and the vertically movable vehicle supporting platforms 1A to 1C, the vehicle enters from the front end or can exit by driving backward. However, it is also possible to insert or to remove the vehicle from either side of the laterally movable vehicle supporting platforms 2A and 2B or the vertically movable vehicle supporting platforms 1A to 1C lowered to the lower vehicle supporting level D. It is further possible to insert the vehicle from the front end or to remove the vehicle from the rear.

The hoist 5 of the suspending cables 6A and 6B respectively fixed at one end 6*c*, can be a type that uses take-up drums for the suspending cables 6A and 6B. The number of the suspending cables is not restricted to two but can be any other appropriate number. For example, when a tilt preventing means is used to prevent the vertically movable vehicle supporting platform from tilting back and forth, each vertically movable vehicle supporting platform can be lifted up and lowered by one suspending cable.

Figure 17:
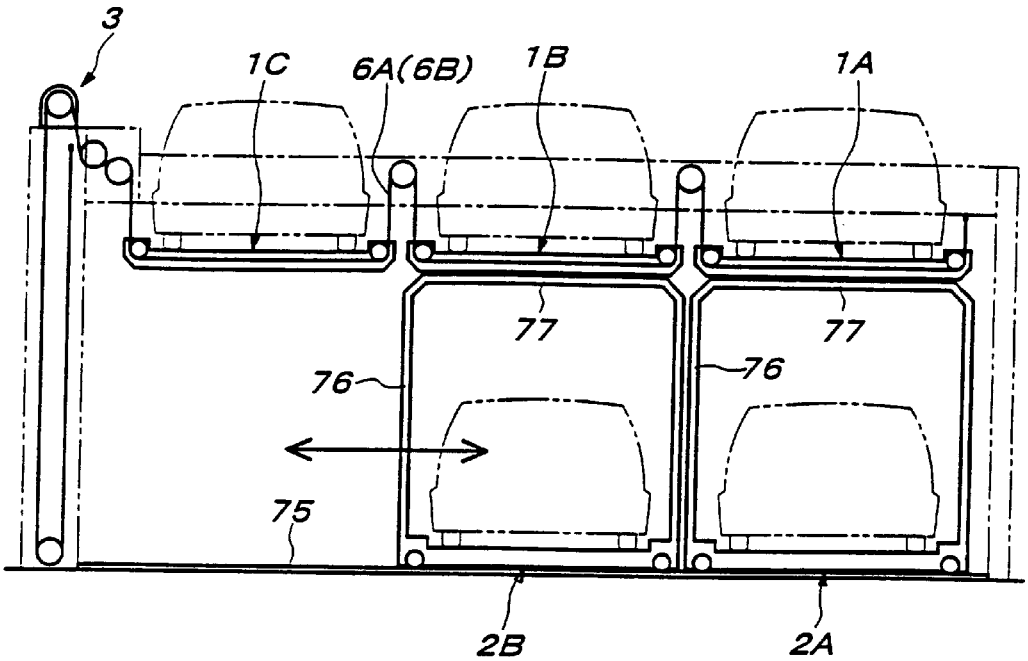

In the foregoing embodiment, as the positioning means provided for each of the vertically movable vehicle supporting platforms 1A t 1C and for switching between positions where the vertically movable vehicle supporting platforms 1A to 1C are prevented from lowering from the upper vehicle supporting level, and a released position is provided for permitting lowering, the carriages 40A and 40B having the laterally movable vehicle supporting platforms 2A and 2B arranged on the lower vehicle supporting level D. As shown in FIG. 17, as long as a carriage type is used in which the laterally movable vehicle supporting platforms 2A and 2B supported on guide rails 75 are installed on the floor surface S for lateral movement, a portal frame 76 can be provided vertically on the laterally movable vehicle supporting platforms 2A and 2B, and a vehicle supporting platform receiving portion 77 functioning as the positioning means can be provided on the portal frame 76.

Figure 18:
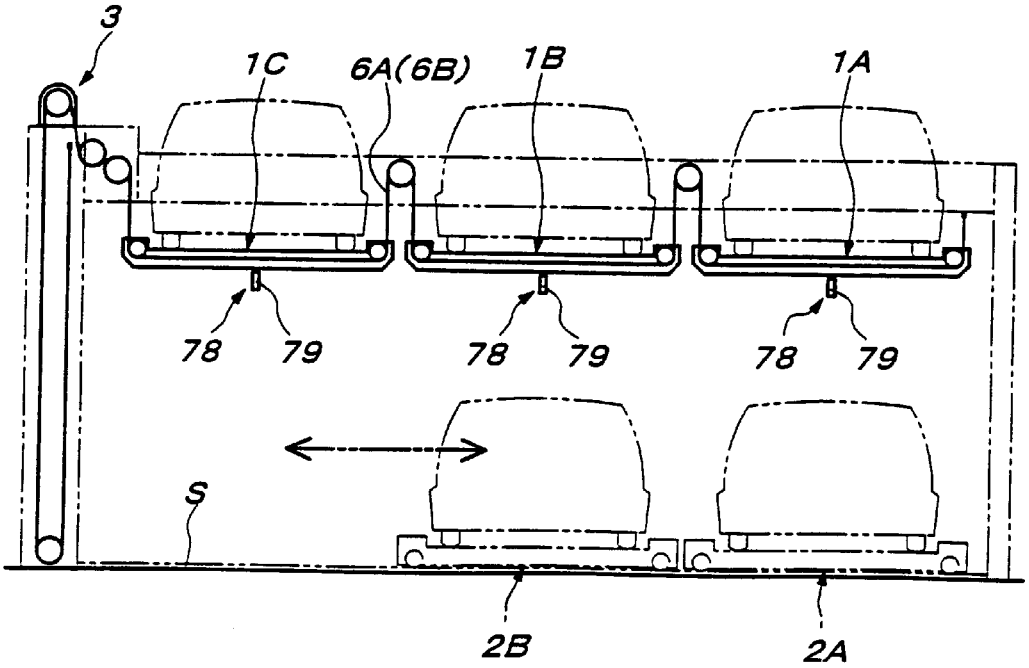
Figure 19:
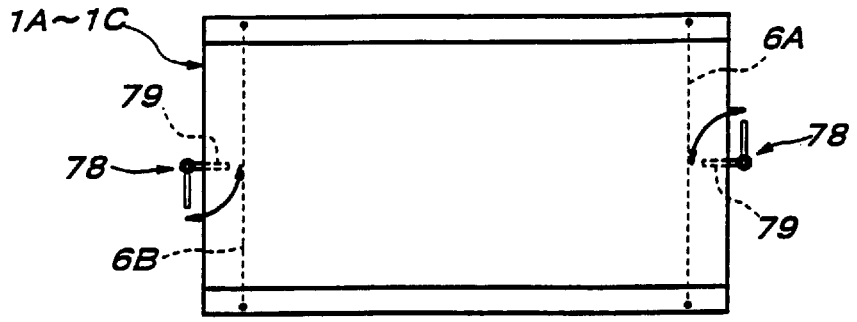

Without using the laterally movable vehicle supporting platforms 2A and 2B of the lower vehicle supporting level D as the positioning means, dedicated positioning means 78 can be provided for each vertically movable vehicle supporting platform 1A to 1C, as shown in FIGS. 18 and 19. A receiving tool 79 which can be switched between an active position receiving a circumferential portion of the vertically movable vehicle supporting platforms 1A to 1C and a non-active position permitting lowering of the vertically movable vehicle supporting platforms 1A to 1C, with a stopper pin which can be engaged and released with respect to an engaging hole provided in the vertically movable vehicle supporting platform 1A to 1C as such a dedicated positioning means 78. Of course, when a plurality of receiving tools 79 or stopper pins are provided in the same vertically movable vehicle supporting platform, it is possible operatively to link a plurality of receiving tools 79 or the stopper pins for positioning the same vertically movable vehicle supporting platforms. It is desirable selectively to release the positioning state for one of the positioning means 78 of the vertically movable vehicle supporting platforms 1A to 1C.

When the laterally movable vehicle supporting platforms 2A and 2B on the lower vehicle supporting level D are not used as the positioning means as described above, possibly no laterally movable vehicle supporting platforms 2A and 2B on the lower vehicle supporting level D are provided, as shown in FIG. 18. In this case, the vehicles are directly supported on the floor surface S directly below respective vertically movable vehicle supporting platforms 1A to 1C. When the vertically movable vehicle supporting platforms 1A to 1C are to be lowered to the lower vehicle supporting level D and if the vehicle is parked at the position directly below the vertically movable vehicle supporting platform to be lowered, such vehicle has to be removed for permitting lowering of the intended vertically movable vehicle supporting platform.

Figure 20:
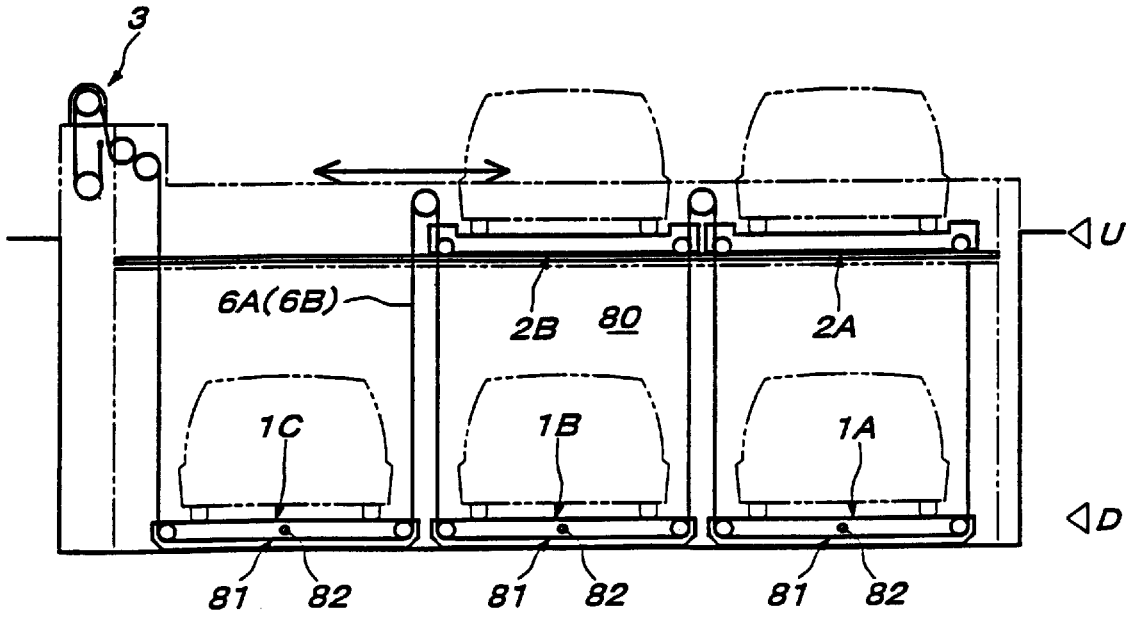
FIG. 20 is an overall front elevation of a modification, in which the vertically movable vehicle supporting platform is in an underground pit.

Furthermore, as shown in FIG. 20, it is possible to construct the parking apparatus according to the present invention to set the lower vehicle supporting level D of the vertically movable vehicle supporting platforms 1A to 1C at an underground pit 80 and the set the upper vehicle supporting level U at the ground level, by placing the vertically movable vehicle supporting platforms within the underground pit 80. The laterally movable vehicle supporting platforms 2A and 2B are arranged at the upper vehicle supporting level. In this case, a positioner means 81 capable of switching between a positioning state preventing the vertically movable vehicle supporting platform 1A to 1C from being lifted from the lower vehicle supporting level D, and a positioning release state permitting lifting, is provided for each vertically movable vehicle supporting platform 1A to 1C. The shown positioner 81 is constructed with a stopper pin 82 releasably engaged with an engaging hole provided in the vertically movable vehicle supporting platform 1A to 1C.

Figure 21:
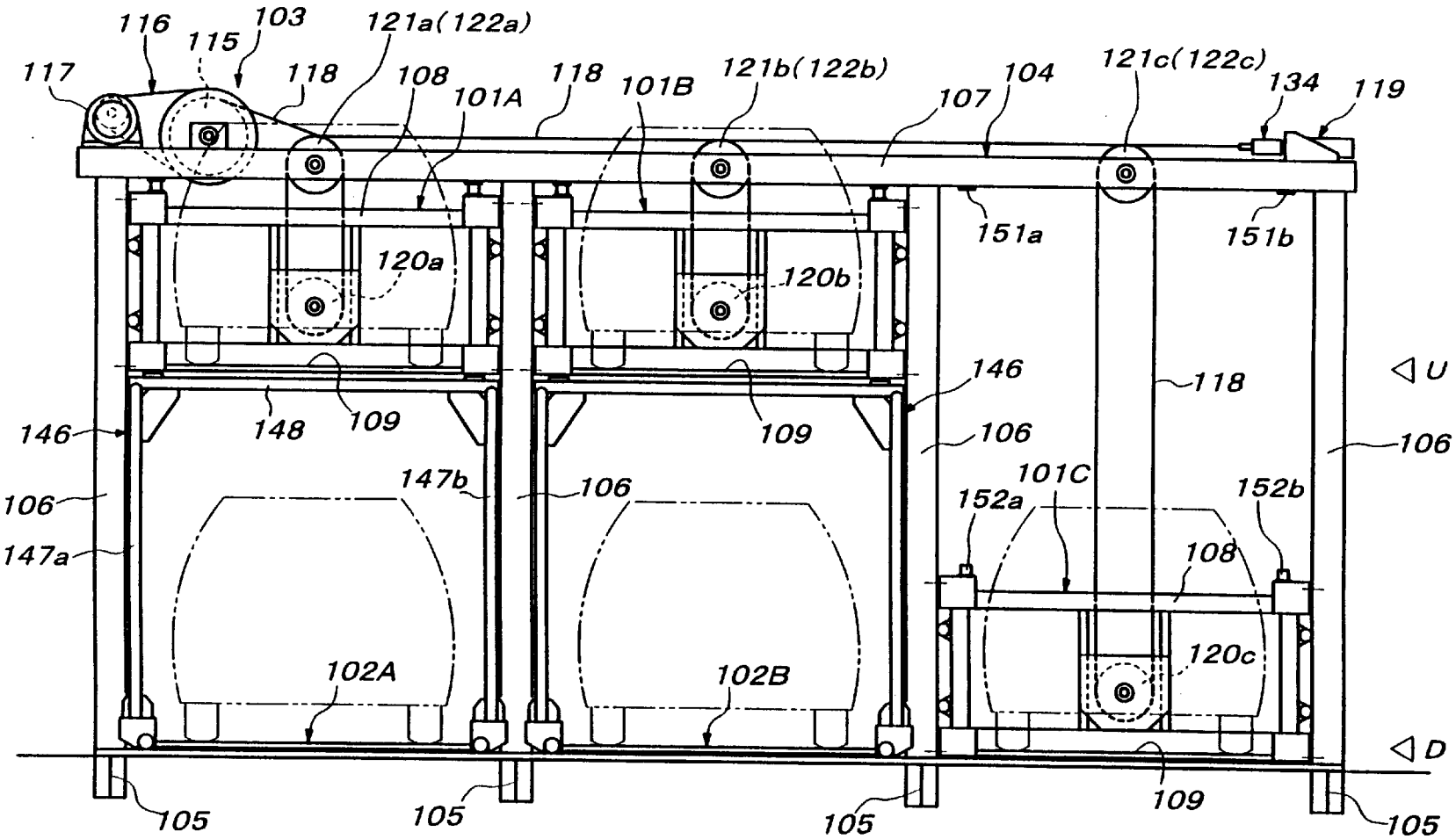
Figure 22:
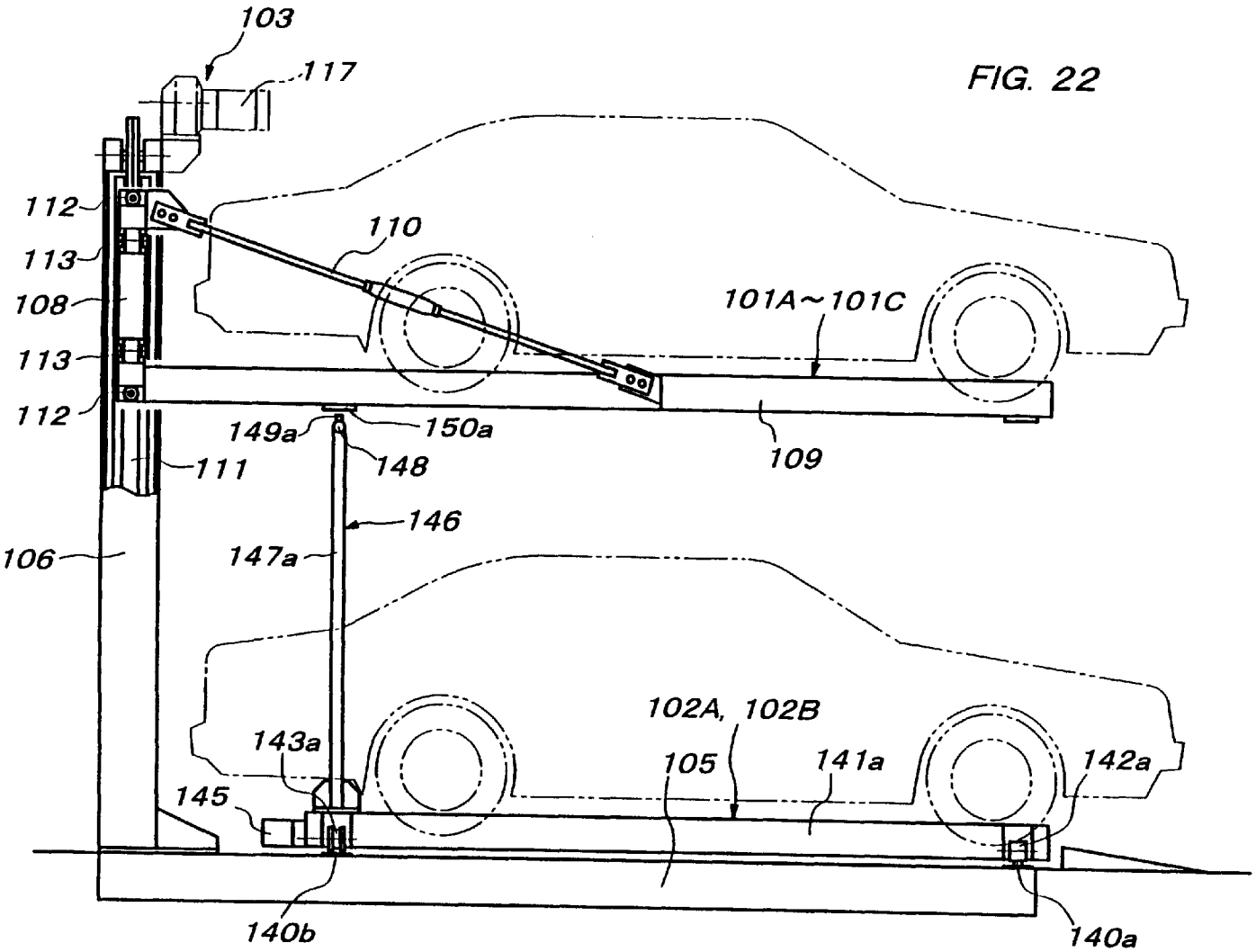
Figure 23:
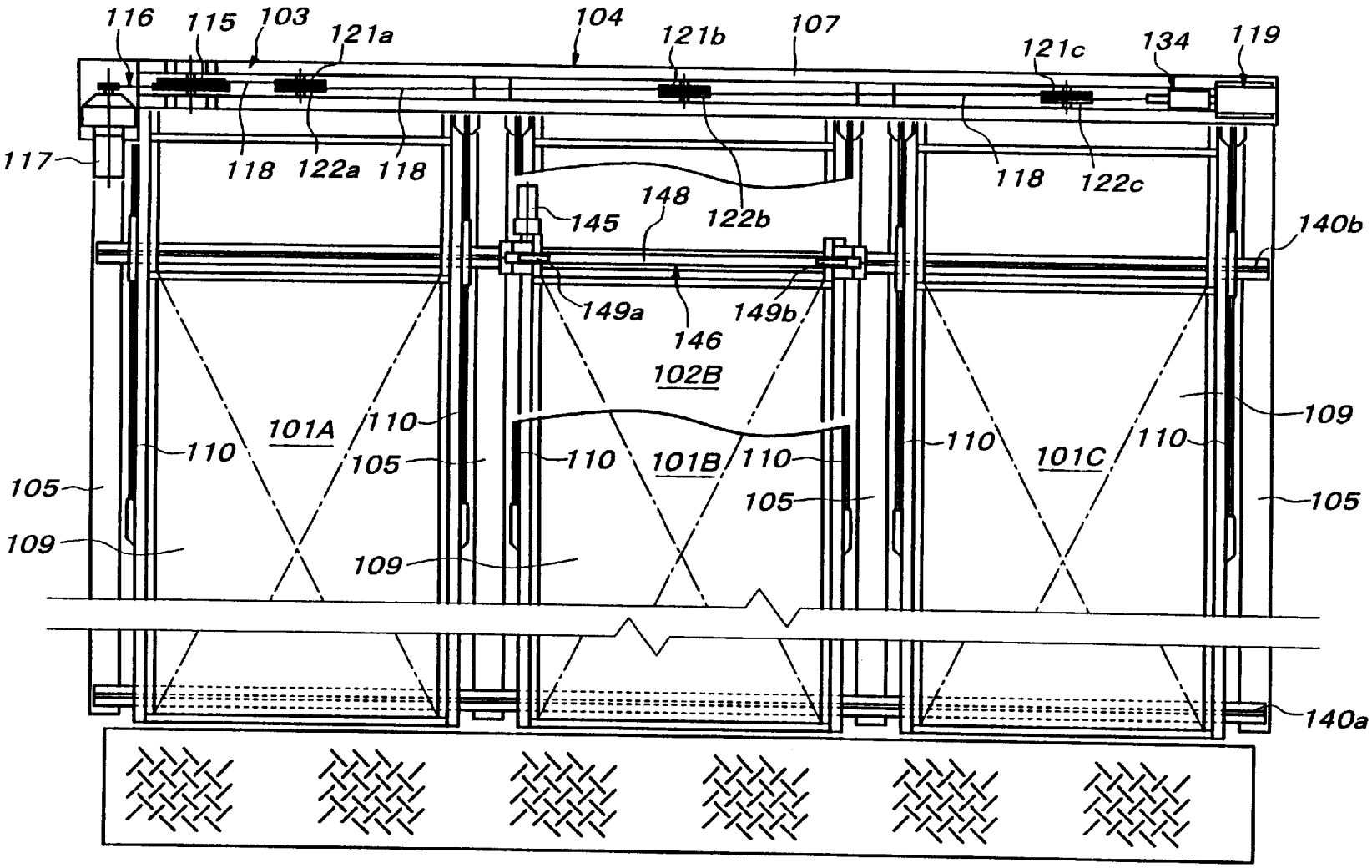

The second embodiment of the parking apparatus according to the present invention which is described herein in detail, is shown particularly with reference to FIGS. 21 to 31. In FIGS. 21 to 23, vertically movable vehicle supporting platforms 101A to 101C each can be lifting and lowered between an upper vehicle supporting level U and a lower vehicle supporting level D, independently of each other. The vertically movable vehicle supporting platforms 101A to 101C are horizontally parallel to each other. Laterally movable vehicle supporting platforms 102A and 102B being one less in number than the number of the vertically movable vehicle supporting platform 101A to 101C. The laterally movable vehicle supporting platforms 102A and 102B are arranged parallel to the vertically movable vehicle supporting platforms 101A to 101C. A lifting drive 103 for the vertically movable vehicle supporting platforms 101A to 101C is mounted on a stationary frame 104.

The stationary frame 104 has a base member 105 buried to be flush with the floor surface, four supporting columns 106 vertically extended from the rear end of the base member 105 corresponding to the intermediate position and both end positions of the vertically movable vehicle supporting platforms 1A to 1C, and beams 107 connecting upper ends of respective supporting columns 106.

Figure 24:
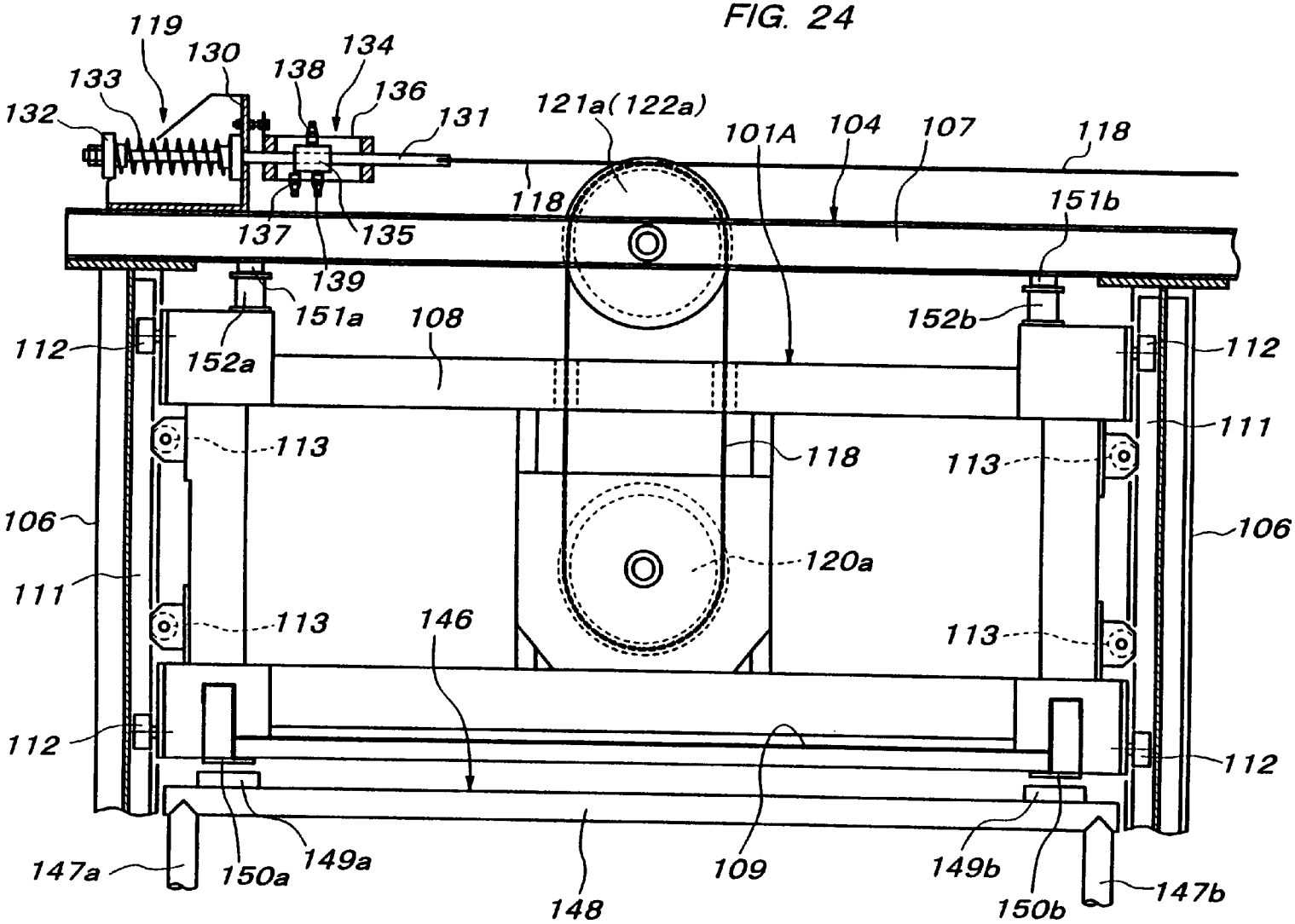

Each of the vertically movable vehicle supporting platforms 1A to 1C has a vertical frame portion 108 located between respective supporting columns 106, horizontal support base portions 109 extended frontward from the lower end of the vertical frame portion 108 in a cantilever fashion, and left and right reinforcement braces extended between the vertical frame portion 108 and the horizontal supporting base portion 109 in an oblique manner. In each supporting column 106 of the stationary frame 104, as shown in FIG. 24, lifting guide rails 111 are formed on the sides adjacent to the vertical frame portion 108 of each vertically movable vehicle supporting platform 101A to 101C. Guide rollers 112 are placed loosely engaged with the lifting guide rails 111 on both sides of the vertical frame portion 108 of each vertically movable vehicle supporting platform 101A to 101C, for positioning the platforms in the horizontal direction, and guide rollers 113 are placed in rotating contact with the surface of the lifting guide rails 111 for positioning the platforms in the left and right direction and are rotatably supported at two upper and lower positions to permit the vertically movable vehicle supporting platforms 1A to 1C to permit the horizontal supporting base portion to be lifted up and down while maintaining a horizontal attitude.

The lifting drive 103 has a rotary wind-up body 115 rotatably supported on a support shaft extending front to back at a position in the vicinity of one end of the beam 107 of the stationary frame 104, a brake motor 117 with a speed reduction gear unit mounted on the beam 107 and coupled with the rotary wind-up body 115 through a transmission chain 116, a wire rope 118 operated to be pulled and extended by the rotary wind-up body 115, a spring unit 119 connecting a free end of the wire rope 118 to the other end of the beam 107, suspended sheaves 120*a* to 120*c* rotatably supported on shafts extending forward and back at the center position of the vertical frame portions 108 of respective vertically movable vehicle supporting platforms 101A to 101C, and front and rear suspending sheaves 121*a* to 121*c* and 122*a* to 122*c* rotatably supported on shafts extending across the beam 107 to be placed directly below the suspended sheaves 120*a* to 120*c*.

Figure 25:
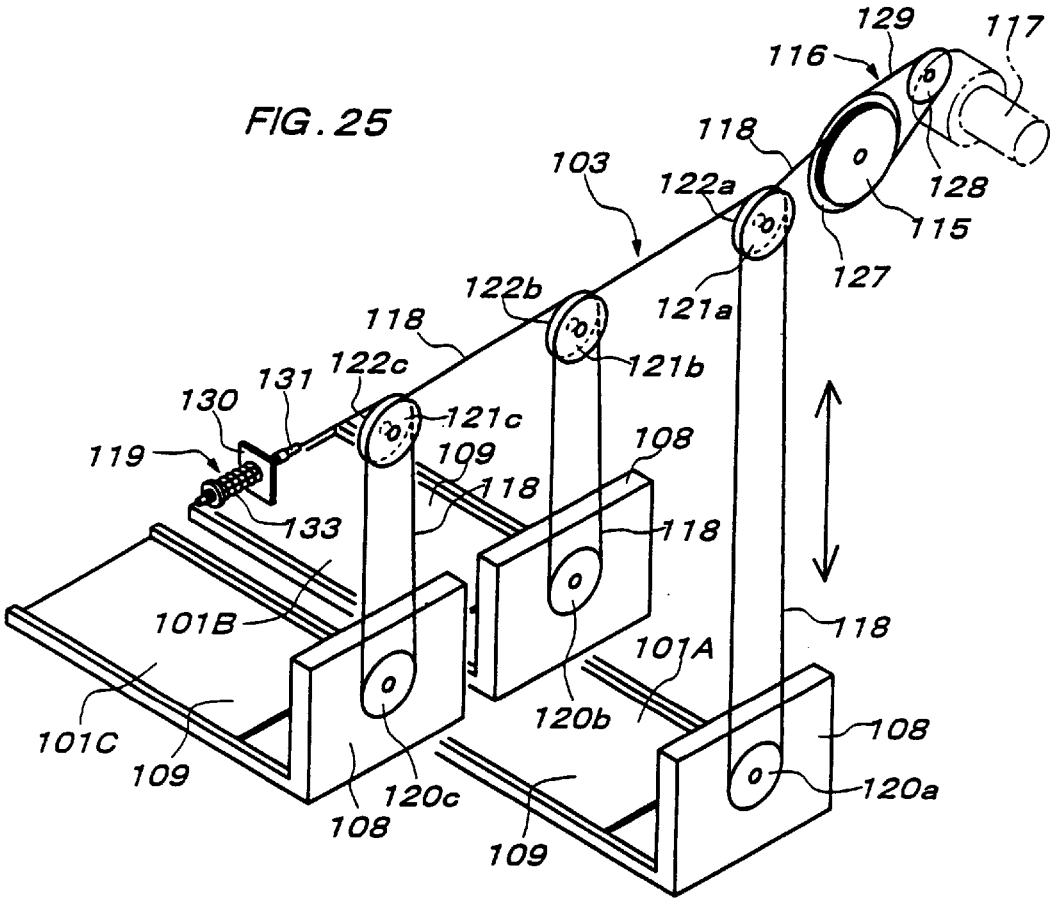

As shown in FIG. 25, the wire rope 118 extends from the rotary wind-up body 115 and engages the beam 107 of the stationary frame 104 through the free end of the spring unit 119 with wrapping around in the same direction as winding direction of the rotary wind-up body 115 on respective ones of the suspending sheaves 121*a*, the suspended sheave 120*a*, the suspending sheave 122*a*, the suspending sheave 121*b*, the suspended sheave 120*b*, the suspending sheave 122*b*, the suspending sheave 121*c*, the suspended sheave 120*c* and the suspending sheave 122*c* in sequence.

Figure 26:
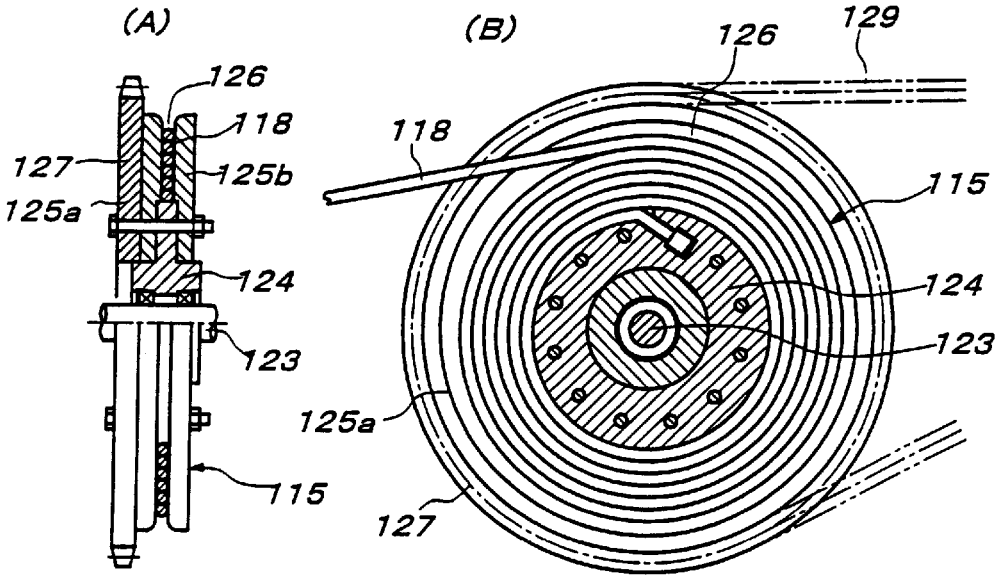
Figure 27:
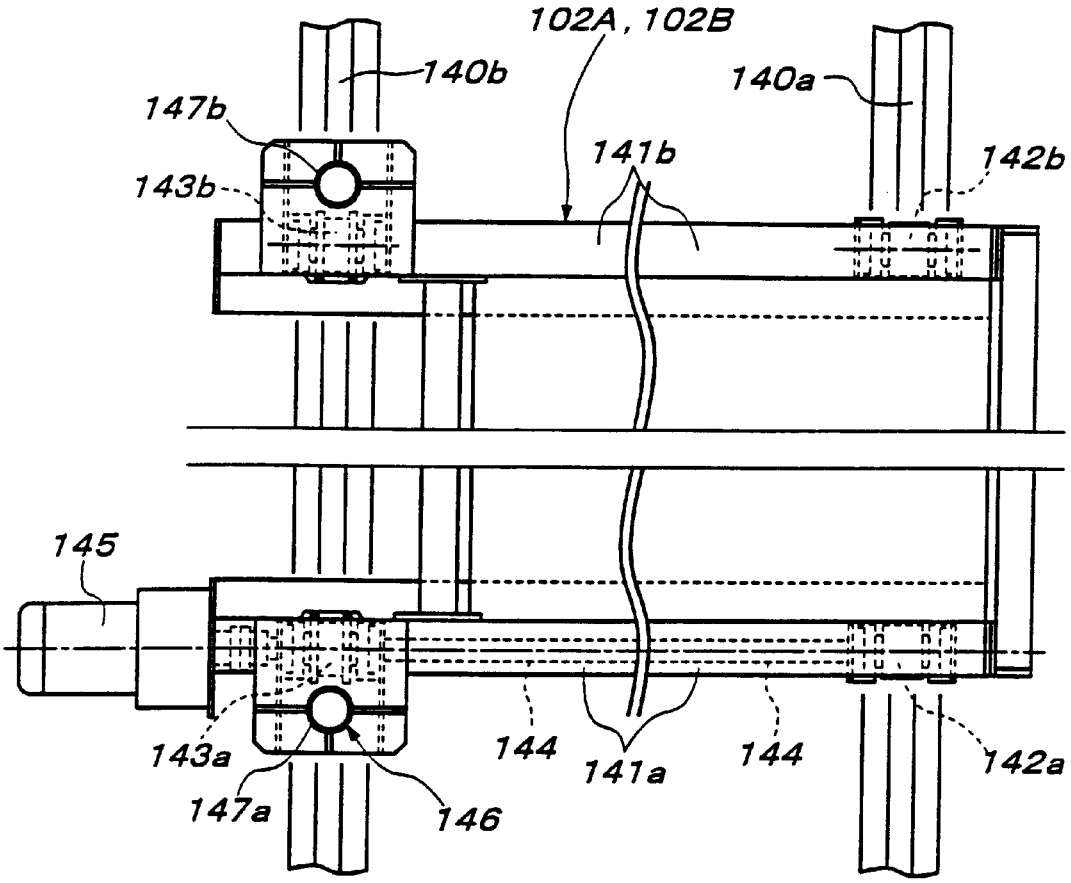
Figure 28:
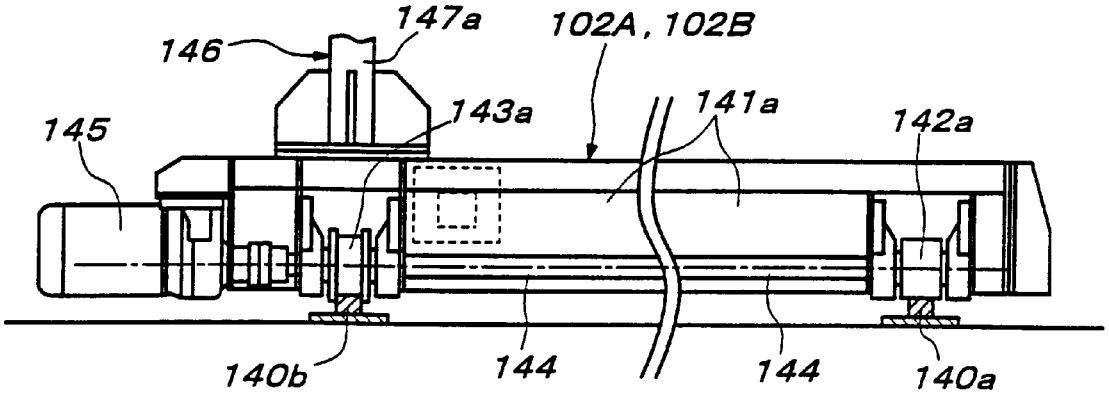

As shown in FIG. 26, the rotary wind-up body 115 is formed by mounting two discs 125*a* and 125*b* on a boss 124 supported on a support shaft 123 with defining a groove 126 extending perpendicularly with respect to the axis of the rotary body 115, and having a width to loosely accommodate a wire rope. The wire rope 118 is wound in spiral fashion within the groove 126. A sprocket 127 is coaxially mounted on one side on the outside of the disc 125*a*. The sprocket 127 is coupled with a sprocket 128 mounted on an output shaft of the brake motor 117 with the speed reduction gear unit by a chain 129 to form the transmission chain 116.

As shown in FIGS. 24 and 25, the spring unit 119 coupling the free end of the wire rope 118 to the beam 107 includes a rod 131 extending laterally through a bracket 130 horizontally mounted on the beam 107, a spring receiving plate 132 mounted on the other end of the rod 131 and a compression coil spring 133 loosely engaged with the rod 131 between the spring receiving plate 132 and the bracket. A sensor 134 is provided in the spring unit 119.

The sensor 134 has a detector 135 mounted on the rod 131 between the bracket 130 and the connected end of the wire rope, a sensor supporting member 136 arranged surrounding the detectable member 135 and is coupled to the bracket 130 at one end, a first proximity switch 137 for detecting a lower limit steady position mounted on the sensor supporting member 136, a second proximity switch 138 for detecting an upper limit steady position, and a third proximity switch 139 for detecting a position exceeding the upper limit.

As shown in FIGS. 21, 22, 27 and 28, each of the laterally movable vehicle supporting platforms 102A is supported in laterally movable fashion on front and rear guide rails 140*a* and 140*b* laterally installed on the base member 105 of the stationary frame 104. Left and right wheels 142*a* and 142*b* are mounted on left and right side frames 141*a* and 141*b*, on the front guide rail 140*a*, and wheels 143*a* and 143*b* with flanges are rotatably supported mounted on the rear guide rail 140*b*. A transmission shaft 144 for cooperatively connecting front and rear wheels 142*a* and 143*a* on one side and a brake motor 145 with a speed reduction gear unit are provided for driving the transmission shaft 143.

A vehicle supporting platform receptacle frame 146 is vertically extended in the vicinity of rear end of each laterally movable vehicle supporting platform 102A and 102B for receiving the vertically movable vehicle supporting platforms 101A to 101C. The vehicle supporting platform receptacle frame 146 is formed into a portal configuration of supporting columns 147*a* and 147*b* extending vertically in the vicinity of the rear ends of the left and right frames 141*a* and 141*b* of the laterally movable vehicle supporting platforms 102A and 102B, and a horizontally extending member 148 extends between the upper ends of both supporting columns 147*a* and 147*b*.

As shown in FIGS. 22 and 24, left and right contact members 150*a* and 150*b* located directly about left and right guide rails 140*a* and 140*b* of the vehicle supporting platform receptacle frame 146 are on the bottom of the horizontal support base portion 109 of each vertically movable vehicle supporting platform 101A to 101C, in the laterally movable vehicle supporting platforms 102A and 102B. On the top of the vertical frame portion 108 of each of the vertically movable vehicle supporting platforms 101A to 101C, left and right contacted members 152*a* and 152*b* are provided for making contact through their contact portions 151*a* and 151*b* with the lower side of the beam 107 of the stationary frame 104 when the vertically movable vehicle supporting platforms 101A to 101C are lifted to their upper limit positions.

In this embodiment of the parking apparatus, vehicles can be put in and taken out at any time in the laterally movable vehicle supporting platforms 102A and 102B at the lower vehicle supporting level D. Inserting automobiles into and removing them from the vertically movable vehicle supporting platforms 101A to 101C at the upper vehicle supporting level U, one of the vertically movable vehicle supporting platforms 101A to 101C has to be lowered for operation to the lower vehicle supporting level D. For example, as shown in FIG. 21, upon insertion and removal of a vehicle in the vertically movable vehicle supporting platform 101C, the laterally movable vehicle supporting platforms 102A and 102B are moved laterally to the positions directly below the vertically movable vehicle supporting platforms 101A and 101B to empty the position directly below the vertically movable vehicle supporting platform 101C. The lateral motion of the laterally movable vehicle supporting platforms 102A and 102B is performed by driving the wheels 142*a* and 143*a* by the brake motor 145 shown in FIGS. 27 and 28 laterally to move the laterally movable vehicle supporting platforms 102A and 102B on the front and rear guide rails 140*a* and 140*b*.

When the position directly below the vertically movable vehicle supporting platform 101C becomes empty, the brake motor 117 of the lifting drive 103 (shown in FIG. 21) is operated to drive the rotary wind-up body 115 forward to extract the wire rope 118. Then, respective vertically movable vehicle supporting platforms 101A to 101C are lowered. As shown in FIG. 24, the vertically movable vehicle supporting platforms 101A and 101B below which the laterally movable vehicle supporting platforms 102A and 102B are located, cannot be lowered from the upper vehicle supporting level U since the contact members 150*a* and 150*b* on their bottom are received by receptacles 149*a* and 149*b* in the vehicle supporting platform receptacle frame 146 on respective laterally movable vehicle supporting platforms 102A and 102B, as the vertically movable vehicle supporting platforms 101A and 101B are maintained at the upper vehicle supporting level U, and only the remaining vertically movable vehicle supporting platform 101C can be lowered.

When one of the vertically movable vehicle supporting platforms 101A and 101C is lowered by extracting the wire rope as described above, the compression coil spring 133 in the spring unit 119 shown in FIG. 24 is in compressed condition due to the load pull exerted on the wire rope 118. The detector 135 of the sensor 134 located at an intermediate position on the side of the spring 133 (variably depending upon whether the vertically movable vehicle supporting platform to be lowered has a vehicle loaded or is empty) between the first, the lower limit steady position detecting proximity switch 137 and the second, the upper limit steady position detecting proximity switch 138. Therefore, the lower limit steady position detecting proximity switch 137 is held in the OFF position. Thus, the strength of the spring 133 is set to establish such condition.

When the vertically movable vehicle supporting platform 101C lowered by the extraction of the wire rope 118 is received on the floor surface (guide rails 140*a* and 140*b*) reaching the lower vehicle supporting level D as shown in FIG. 21, the wire rope 118 is pulled toward the spring unit 119 by the spring 118 by a further extraction of the wire rope 118. The detectable member 135 of the sensor 134 is shifted toward the first, the lower limit steady position detecting proximity switch 137. Then, the detectable member 135 is detected by the first, the lower limit steady position detecting proximity switch 137. By stopping the motor 117 of the lifting drive 3 by braking in response to the detection signal of the first, the lower limit position detecting proximity switch 137, lowering of the vertically movable vehicle supporting platform can be terminated while maintaining the wire rope tensioned by the biasing force of the spring 133.

As stated above, the vertically movable vehicle supporting platform 101C is lowered to the lower vehicle supporting level D. Insertion or removal of a vehicle can be achieved when the vehicle supporting platform 101C is lowered to the lower vehicle supporting level D. Vehicles can be inserted into or removed from the other vertically movable vehicle supporting platforms 101A and 101B, after a lateral motion of the laterally movable vehicle supporting platforms 102A and 102B to make a position empty directly below the objective vertically movable vehicle supporting platforms 101A or 101B. The rotary wind-up member 115 of the lifting drive 103 is rotated forward to extract the wire rope 118 to lower one of the vertically movable vehicle supporting platforms 101A or 101B, to an empty lower position to the lower vehicle supporting level D.

The vertically movable vehicle supporting platform, for example vertically movable vehicle supporting platform 101C shown in FIG. 21, located in the lower vehicle supporting level D, has to be lifted to the upper vehicle supporting level U to enable lateral motion of the laterally movable vehicle supporting platforms 102A and 102B in advance of inserting or removing a vehicle into a vertically movable vehicle supporting platform 101A or 101B. In this case, the rotary wind-up body 115 is driven in a reverse direction by the motor 117 of the lifting drive 103 to wind-up the wire rope 118.

By winding up the wire rope, the vertically movable vehicle supporting platforms 101A to 101C are lifted by the wire rope 118 in the sequential order of the empty and then the loaded vertically movable vehicle supporting platforms. In the example illustrated in FIG. 21, the vertically movable vehicle supporting platforms 101A and 101B are already located in the upper vehicle supporting level U and are positioned directly after lifting, contacting the contacted member 152*a* and 152*b* with the contact portions 151*a* and 151*b* on the side of the stationary frame 104 (beam 107). Thereafter, only the vertically movable vehicle supporting platform 101C located at the lower vehicle supporting level D is lifted.

When the vertically movable vehicle supporting platform 101C reaches the upper vehicle supporting level U, and is positioned by contacting the contacted members 152*a* and 152*b* with the four contact portions 151*a* and 151*b* on the side of the stationary frame 104, the wire rope 118 wound up to cause compression of the spring 133 of the spring unit 119 to move the detectable member 135 of the sensor 134 away from the spring 133. As a result, since the end portion on the side of the spring 133 of the detectable member 135 is moved away from the second, the upper limit steady position detecting proximity switch 138 to switch it from ON to OFF. In cooperation therewith, the motor 117 of the lifting drive 103 is braked and stopped to terminate upward travel of the vertically movable vehicle supporting platform 101C so that it does not exert excessive tension on the wire rope 118.

If the upper limit steady position detecting proximity switch 138 does accidentally not act normally due to a failure of the control system or any other reason which continues driving of the rotary wind-up body 115 in the reverse direction, the wire rope 118 causes a further compression of the spring 133 to shift the detectable member 135. Then, the third, the proximity switch 139 for detecting a position exceeding the upper limit is switched OFF to stop the motor 117 of the lifting drive 103.

A stopping control of the motor 117 of the lifting drive 103 is arranged on each vertically movable vehicle supporting platform 101A to 101C, and is performed in cooperation with the operation of the lower and upper limit reaching detection switches of the vertically movable vehicle supporting platforms 101A to 101C. The spring 133 of the spring unit 119 contributes to prevent improper relaxation of the wire rope upon lowering of the vertically movable vehicle supporting platform 101A to 101C.

In this embodiment of the present invention, a portal vehicle supporting platform receptacle frame 146 is provided in the laterally movable vehicle supporting platforms 102A and 102B for each vertically movable vehicle supporting platform 101A to 101C as positioning means and switching between a positioning state and preventing lowering of the corresponding vertically movable vehicle supporting platform 101A to 101C from the upper vehicle supporting level U and release to permit lowering. As in the first described embodiment of the present invention with references to FIGS. 1–20, when the laterally movable vehicle supporting platforms 102A and 102B are of the type suspended from a laterally movable carriage moving sideways at the position directly below the vertically movable vehicle supporting platforms 101A to 101C at the upper vehicle supporting level U, it is possible to use the laterally movable carriage as the vehicle supporting platform receptacle frame to serve as the positioning means.

Figure 29:
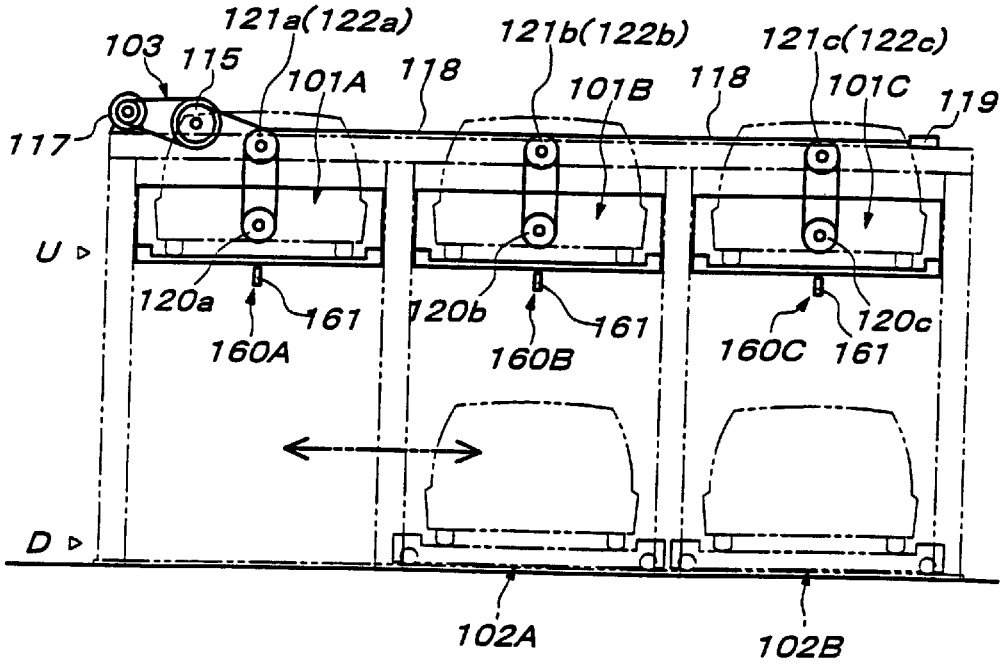

As shown in FIG. 29, it is also possible instead of using the laterally movable vehicle supporting platforms 102A and 102C on the lower vehicle supporting level as the positioning means, independently to provide positioners 160A to 160C adopted to receive respective vertically movable vehicle supporting platforms 101A to 101C at the upper vehicle supporting level U. Each positioner 160A to 160C includes a receptacle 161 which is horizontally rockable or reciprocally movable between an active position receiving the vertically movable vehicle supporting platforms 101A to 101C and a inactive position permitting lowering of the vertically movable vehicle supporting platforms 101A to 101C. The receptacles 161 of the respective positioners 160A to 160C do not cooperate with each other and can be switched between the active position and the inactive position independently of each other.

Even in the case where the laterally movable vehicle supporting platforms 102A and 102B on the lower vehicle supporting level D are used as the positioning means as in the foregoing embodiments to prevent from dropping the vertically movable vehicle supporting platform lifted to the upper vehicle supporting level U in advance of lateral motion of the laterally movable vehicle supporting platforms 102A and 102B (namely, the vertically movable vehicle supporting platform located directly above the empty space). In this case, the receptacle provided for respective vertically movable vehicle supporting platforms 101A to 101C at the upper vehicle supporting level U can be cooperatively switched between the active position and the release position.

Figure 30:
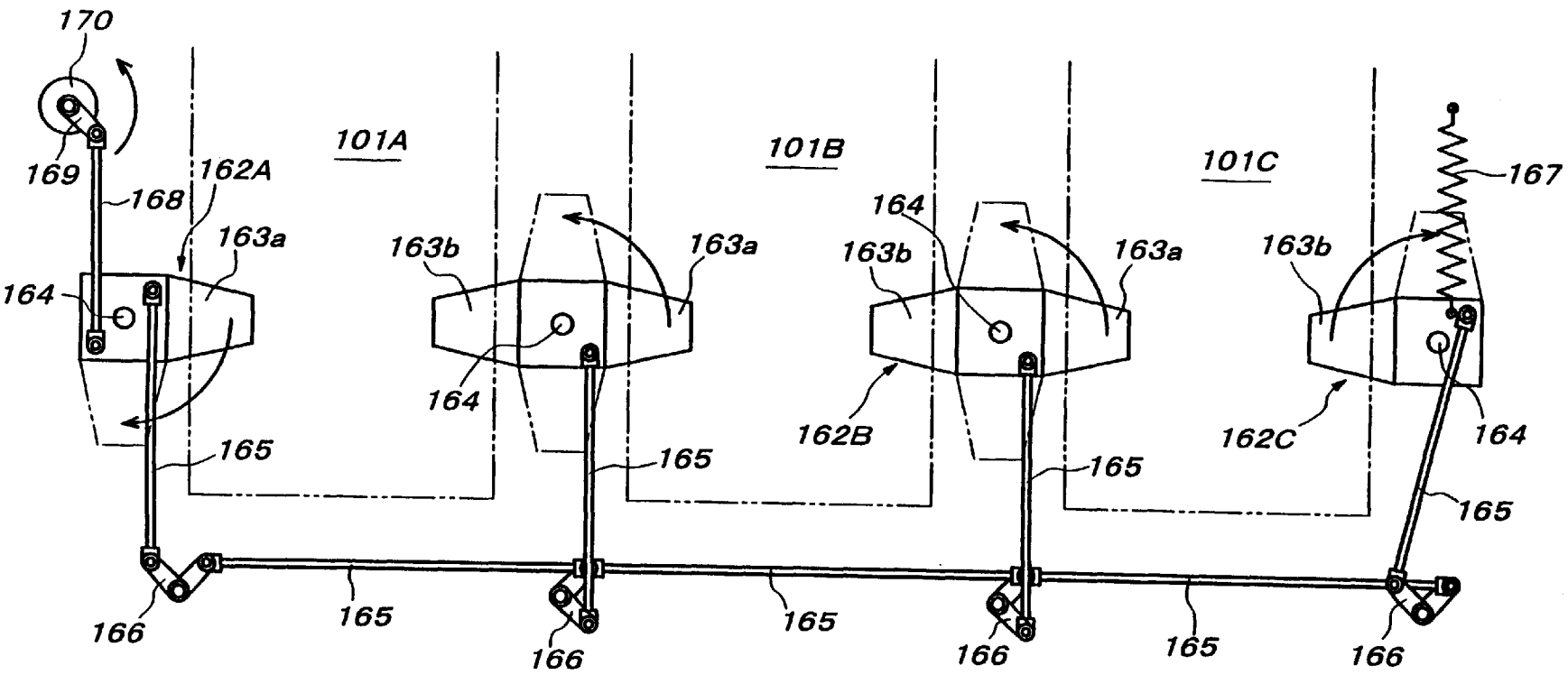

One embodiment of the receptacle is shown in greater detail in FIG. 30. The receptacles 162A to 162C use left and right receptacle members 163*a* and 163*b* for independently receiving both of the left and right side edges of the vertically movable vehicle supporting platforms 101A to 101C at the upper vehicle supporting level U. Each receptacle member 163*a* and 163*b* is pivotably supported on a vertical support shaft 164 for horizontal rocking motion between the active position shown by solid line and the inactive position shown by broken line. For cooperatively switching all receptacles between the active position and the inactive position, all of the receptacles are cooperatively coupled through a link 165 and a relaying L-shaped lever 166. Each receptacle member 163*a* and 163*b* includes a spring 167 switching the receptacle members 163*a* and 163*b* at the active position, and a motor 170 coupled to one receptacle member 163*a* through a link 168 and a drive lever 169. Accordingly, receptacle members 163*a* and 163*b* of all receptacles 162A to 162C are simultaneously switched into the inactive position against the force of the spring 167. By interrupting the power to the motor 170, the receptacle members 163*a* and 163*b* of all receptacles 162A to 162C are simultaneously returned to the active position by the force of the spring 167.

If the laterally movable vehicle supporting platforms 102A and 102B at the lower vehicle supporting level D are not used, the laterally movable vehicle supporting platforms 102A and 102B at the lower vehicle supporting level need not be provided, as shown in FIG. 29. In this case, the vehicles are directly supported on the floor surface S directly below respective vertically movable vehicle supporting platforms 101A to 101C. Upon lowering of the vertically movable vehicle supporting platforms 101A to 101C to the lower vehicle supporting level D, and when the vehicle is present directly below the vertically movable vehicle supporting platform to be lowered, it becomes necessary once to remove the vehicle.

Figure 31:
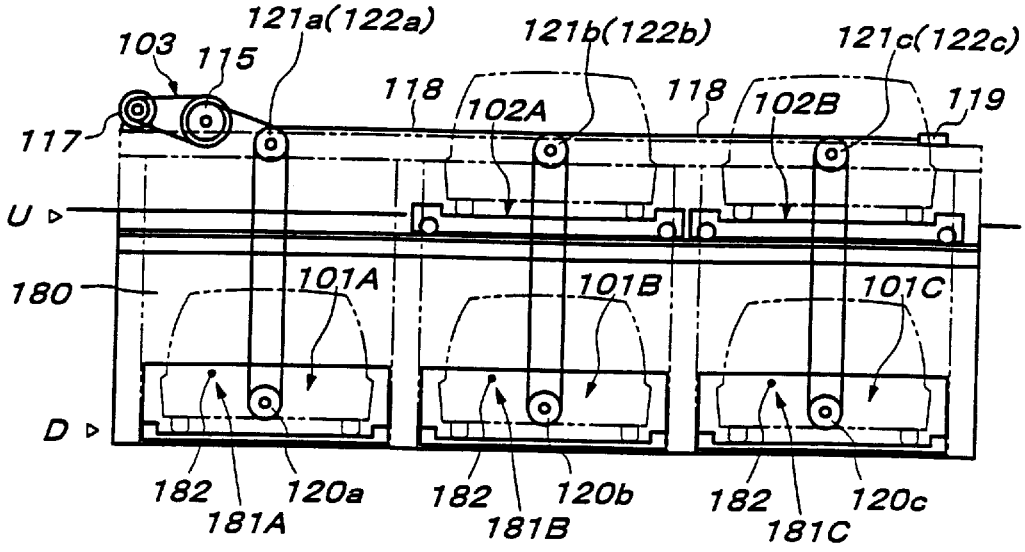

Also, as shown in FIG. 31, it is possible to arrange the vertically movable vehicle supporting platforms 101A to 101C within an underground pit 180 so that the lower vehicle supporting level D of the vertically movable vehicle supporting platforms 101A to 101C is located on the bottom of the underground pit 180, and the upper vehicle supporting level is located at ground level, and the laterally movable vehicle supporting platforms 102A and 102B are located on the upper vehicle supporting level. In this case, the positioning means 181A to 181C which can be positioned to prevent the vertically movable vehicle supporting platforms 101A to 101C from lifting from the lower vehicle supporting level D, and in a released condition permitting a lifting, are provided for respective vertically movable vehicle supporting platforms 101A to 101C. Positioning means 181A to 181C employ stopper pins 182 releasably engaging with engaging holes in respective vertically movable vehicle supporting platforms 101A to 101C.

In either of the first and second described embodiments, the parking apparatus is shown with three vertically movable vehicle supporting platforms and one less laterally movable vehicle supporting platform. However, the parking apparatus can also be constructed with two vertically movable vehicle supporting platforms and one laterally movable vehicle supporting platform, or four or more vertically movable vehicle supporting platforms and one less laterally movable vehicle supporting platforms. Furthermore, a plurality of such parking apparati can also be provided in parallel to obtain large scale parking facilities able to receive a greater number of vehicles.

It is also possible to combine the construction of the foregoing first embodiment and the construction of the foregoing second embodiment. For example, respective vertically movable vehicle supporting platforms 101A to 101C of the first embodiment can be built to employ the lifting drive 103 of the second embodiment. Conversely, it is also possible to build the parking apparatus to drive the vertically movable vehicle supporting platforms 101A to 101C of the second embodiment by the lifting drive 3 of the first embodiment.

I claim:

1. A parking apparatus comprising (a) a frame having a top and two sides, (b) a plurality of vertically movable vehicle supporting platforms for being lifted and lowered between a lower vehicle supporting level and an upper vehicle supporting level and arranged horizontally side by side between said sides of said frame, (c) a plurality of laterally movable vehicle supporting platforms, said last plurality being one less than the plurality of said vertically movable vehicle supporting platforms, said laterally movable vehicle supporting platforms having an upper side, (d) positioning means for respective vertically movable vehicle supporting platforms for selectively preventing said vertically movable vehicle supporting platforms from being lowered from said upper vehicle supporting level or from being lifted from a vehicle positioning state of said lower vehicle supporting level, said positioning means being switchable from said vehicle positioning state to a released state in which lifting or lowering said vertically movable vehicle supporting platform is enabled, said positioning means being a vehicle supporting platform receptacle disposed at said upper side of each of said laterally movable vehicle supporting platforms for receiving a vertically movable vehicle supporting platform, with a vertically movable vehicle supporting platform being lifted and lowered in an empty space provided after lateral motion of a laterally movable vehicle supporting platform, (e) a lifting drive for said vertically movable vehicle supporting platforms, said lifting drive being located at one end of said sides and including a motor, and a wind-up body driven by said motor, (f) a plurality of suspending cables each extending from one side to said wind-up body, one end of each of said cables being attached to suspend all the vertically movable vehicle supporting platforms between said sides for pulling and releasing the other end of said cable by said wind-up body, (g) a rotatable suspending guide wheel on each vehicle suspending platform, and a stationary guide wheel rotatably supported from said top, said suspending cables each being passed around said suspending guide wheel and the stationary guide wheel for lifting and lowering one of said vertically movable vehicle supporting platforms suspended by said suspending cable, in cooperation with one of said positioning means.

2. The parking apparatus of claim 1, wherein a suspending cable is a chain attached at both ends to said frame, and said wind-up body has driving sprockets coupled with said motor, and lifting and lowering sprockets arranged below said driving sprockets, and said suspending cables are lifted and lowered by said lifting sprockets between one cable end attached to said frame and said driving sprockets.

3. The parking apparatus of claim 1, wherein said wind-up body is a motor driven rotary body adapted to wind up said suspending cables, said cables being wire ropes having one end attached to said frame and are adapted to be pulled and released by said rotary wind-up body at their other ends, said wire ropes suspending respective vertically movable vehicle supporting platforms and are wrapped around suspended sheaves rotatably supported on respective vertically movable vehicle supporting platforms, and suspending sheaves rotatably supported on said frame at a position above said suspended sheaves.

4. The parking apparatus of claim 3, wherein said rotary wind-up body is wrapped around in a groove having one wire rope spirally wound therein.

5. The parking apparatus of claim 4, further comprising a spring between an end of said wire rope at the opposite side of said rotary wind-up body and said frame to maintain said wire rope tensioned by the force of said spring when a lowered vertically movable vehicle supporting platform is received at said lower vehicle supporting level.

6. The parking apparatus of claim 5, further comprising a sensor for detecting the end of said wire rope being tensioned by the force of said spring, for terminating driving of said rotary wind-up body after said vertically movable vehicle supporting platforms are at the upper vehicle supporting level.

7. The parking apparatus of claim 4, further comprising a spring between an end of said wire rope on the opposite side of said rotary wind-up body, and a motion sensor for detecting the end of said wire rope being tensioned by the force of said spring, for terminating driving of said rotary wind-up body after said vertically movable vehicle supporting platforms are at the upper vehicle supporting level.

8. The parking apparatus of claim 3, further comprising a spring between an end of said wire rope at the opposite side of said rotary wind-up body and said frame to maintain said wire rope tensioned by the force of said spring when a lowered vertically movable vehicle supporting platform is received at said lower vehicle supporting level.

9. The parking apparatus of claim 8, further comprising a sensor for detecting the end of said wire rope being tensioned by the force of said spring, for terminating driving of said rotary wind-up body after said vertically movable vehicle supporting platforms are at the upper vehicle supporting level.

10. The parking apparatus of claim 3, further comprising a spring between an end of said wire rope on the opposite side of said rotary wind-up body, and a motion sensor for detecting the end of said wire rope being tensioned by the force of said spring, for terminating driving of said rotary wind-up body after said vertically movable vehicle supporting platforms are at the upper vehicle supporting level.

11. The parking apparatus of claim 1, wherein said suspending cables are first suspending cables, the apparatus further comprising a plurality of second suspending cables for suspending said vertically movable vehicle supporting platforms in a plurality of forward and backward positions.

12. The parking apparatus of claim 11, further comprising a tilt preventer for preventing tilting of said vertically movable vehicle supporting platforms.

13. The parking apparatus of claim 12, wherein said vertically movable vehicle supporting platforms have side edges, said tilt preventer has two linking cables each connected at both ends to a left and right side edge and wrapped around guide wheels rotatably supported at fixed positions at intermediate portions of said linking cables, one of said linking cables being pulled when the left edge of said vertically movable vehicle supporting platform is lowered, to lower the right edge, and the other of said linking cables being pulled when the right edge is lowered, to lower the left edge.

14. The parking apparatus of claim 1, further comprising a tilt preventer for preventing tilting of said vertically movable vehicle supporting platforms.

15. The parking apparatus of claim 14, wherein said vertically movable vehicle supporting platforms have side edges, said tilt preventer has two linking cables each connected at both ends to a left and right side edge and wrapped around guide wheels rotatably supported at fixed positions at intermediate portions of said linking cables, one of said linking cables being pulled when the left edge of said vertically movable vehicle supporting platform is lowered, to lower the right edge, and the other of said linking cables being pulled when the right edge is lowered, to lower the left edge.

* * * * *